US005288745A

United States Patent [19]

Texter et al.

[11] Patent Number: 5,288,745

[45] Date of Patent: Feb. 22, 1994

[54] IMAGE SEPARATION SYSTEM FOR LARGE VOLUME DEVELOPMENT

[75] Inventors: John Texter, Rochester; Wayne A. Bowman, Walworth; Glenn T. Pearce, Fairport; David S. Bailey, Rochester, all of N.Y.

[73] Assignee: Eastman Kodak Company, Rochester, N.Y.

[21] Appl. No.: 952,443

[22] Filed: Sep. 28, 1992

[51] Int. Cl.[5] ..... G03C 5/54

[52] U.S. Cl. ..... 430/237; 430/214; 430/215

[58] Field of Search ..... 430/212, 214, 220, 237

[56] References Cited

U.S. PATENT DOCUMENTS

| | | | |
|---|---|---|---|
| 3,220,835 | 11/1965 | Land . | |
| 3,277,550 | 1/1966 | Whitmore et al. . | |
| 3,477,849 | 11/1969 | Becker . | |
| 3,498,785 | 3/1970 | Bloom et al. . | |
| 3,730,718 | 5/1973 | Dannhauser . | |
| 3,734,726 | 5/1973 | Figueras et al. . | |
| 3,743,504 | 7/1973 | Dappen et al. . | |
| 3,751,406 | 8/1973 | Bloom . | |
| 3,885,969 | 5/1975 | Kruck . | |
| 3,888,669 | 6/1975 | Cardone . | |
| 3,928,312 | 12/1975 | Fleckenstein . | |
| 4,055,429 | 10/1977 | Holmes et al. . | |
| 4,056,394 | 11/1977 | Hannie | 430/215 |
| 4,060,417 | 11/1977 | Cieciuch et al. . | |
| 4,076,529 | 2/1978 | Fleckenstein et al. | 430/223 |
| 4,088,499 | 5/1978 | Brust et al. . | |
| 4,141,730 | 2/1979 | Minagawa et al. . | |
| 4,267,265 | 5/1981 | Sugimoto et al. | 430/523 |
| 4,317,892 | 3/1982 | Abel | 525/194 |
| 4,328,301 | 5/1982 | Wright | 430/215 |
| 4,401,746 | 8/1983 | Pfingston | 430/215 |
| 4,407,929 | 10/1983 | Boie et al. | 430/212 |
| 4,420,556 | 12/1983 | Booms et al. | 430/549 |
| 4,450,224 | 5/1984 | Klein et al. | 430/213 |
| 4,459,346 | 7/1984 | Bishop et al. | 430/212 |
| 4,485,165 | 11/1984 | Finn et al. | 430/212 |
| 4,504,569 | 3/1985 | Abel et al. | 430/214 |
| 4,519,689 | 5/1985 | Kinsman et al. | 354/304 |
| 4,629,677 | 12/1986 | Katoh | 430/215 |
| 4,636,455 | 1/1987 | Aono et al. | 430/213 |
| 4,740,496 | 4/1988 | Vanier | 503/227 |
| 4,774,162 | 9/1988 | Shibata et al. | 430/213 |
| 4,865,946 | 9/1989 | Bowman et al. | 430/215 |
| 5,023,162 | 6/1991 | Yamanouchi et al. | 430/213 |
| 5,112,720 | 5/1992 | Karino | 430/214 |

FOREIGN PATENT DOCUMENTS

| | | |
|---|---|---|
| 0144059B1 | 2/1989 | European Pat. Off. . |
| 0115303B1 | 10/1989 | European Pat. Off. . |

*Primary Examiner*—Richard L. Schilling

*Attorney, Agent, or Firm*—Paul A. Leipold

[57] ABSTRACT

In accordance with this invention a diffusion transfer process is provided for forming a color photographic image comprising the steps of: (a) using an integral element comprising one and only one dimensionally stable layer comprising a coating support, and coated thereon in reactive association a mordant layer comprising a material which binds a diffusible dye, an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer that allows the passage of solutions for processing said element when said element is contacted with an external processing bath, and wherein said barrier layer impedes the diffusion out of said element of the diffusible dye formed from said diffusible dye forming compound; (b) exposing said element to actinic radiation; (c) processing said element by contacting said element to an external bath containing compounds selected from the group consisting of conventional color developer compounds of the primary amine type, compounds which activate the release of incorporated color developers, and compounds which activate development by incorporated dye developers; (d) washing said element to remove compounds imbibed in step (c). In a preferred embodiment said integral element further comprises a stripping layer coated intermediate the mordant layer and dye forming layer. In another preferred embodiment said process further comprises the step of stripping said mordant and support from said diffusible dye forming layer.

70 Claims, 3 Drawing Sheets

IMAGE SEPARATION SYSTEM FOR LARGE VOLUME DEVELOPMENT

TECHNICAL FIELD

This invention relates to photographic imaging systems that utilize silver halide based radiation sensitive layers and associated formation of image dyes in a wet development process and to systems which utilize polymeric barrier layers to control diffusion of particular components. In particular, this invention relates to such systems where the resulting dyes, when the photographic elements are substantially wet, have substantial solubility and freedom to diffuse. More particularly, this invention relates to color diffusion transfer systems that utilize large volume development processing baths.

BACKGROUND ART

Conventional Wet Silver Halide Processes

In conventional wet processing of silver halide based color photographic elements, an imagewise exposed element, for example color paper designed to provide color prints, is processed in a large volume of color developer solution. The element is typically immersed in a deep tank of processing solution wherein the volume of solution is much greater than the volume of the element therein immersed and wherein the volume of solution is much greater than the swollen volume of the light sensitive emulsion layers coated upon the photographic element. The developer typically reduces the exposed silver halide of the element to metallic silver and the resulting oxidized color developer reacts with incorporated dye-forming couplers to yield dye images corresponding to the imagewise exposure. Since silver is generally gray and desaturates the pure colors of the dyes, it is desirable to remove it from the dye images. Silver is conventionally separated from the dye images by a process of bleaching the silver to a silver halide and removing the silver halide by using an aqueous solvent, a fixing bath. This fixing bath also removes the undeveloped original silver halide. Commonly, the bleach and fix are combined into one solution, a bleach-fix solution.

Color Diffusion Transfer Systems

Diffusion transfer processes in photography are well known. Cieciuch et al., in U.S. Pat. Nos. 3,719,489 and 4,060,417, describe photographic processes employing certain compounds which are stable in photographic processing composition but capable of undergoing cleavage in the presence of an imagewise distribution of silver ions created during processing of a silver halide emulsion to liberate a photographically active reagent or a dye in an imagewise distribution corresponding to that of said silver ions. Depending on the photographic process and the result it is desired to achieve the inert parent compound may be diffusible or substantially nondiffusible in the processing solution and the reagent liberated also may be diffusible or substantially nondiffusible in the processing composition.

Pfingston, in U.S. Pat. No. 4,401,746, discloses a diffusion transfer element comprising in order a topcoat protective layer, light-sensitive and dye providing layers, a stripping layer, a dyeable stratum, and a support. The processing composition may be applied to the exposed photosensitive element by dipping. The developing agent may be any of those commonly employed. The dyeable stratum together with any other image-receiving components are separable from the photosensitive component using the stripping layer.

Finn and DeBoer, in U.S. Pat. No. 4,485,165, disclose diffusion transfer elements for producing monochromatic dye images comprising (1) a support having thereon a layer of nondiffusible dye image-providing material, a stripping layer, an opaque layer, and a silver halide emulsion layer; (2) a transparent cover sheet; and (3) an opaque processing composition for appliation between the lenient and cover sheet. A dye mordant layer may also be present on the element or cover sheet. After exposure and processing, the layer of nondiffusible dye image-providing material on a support is stripped away to provide a monochromatic retained dye image without the need for bleaching and fixing.

Kinsman et al., in U.S. Pat. No. 4,519,689, disclose a method and apparatus for processing discrete sheets of rapid access film exemplified by diffusion transfer film. The apparatus comprises opposing transport webs; these webs convey donor and receiver film sheets and means are provided for applying processing fluid between these donor and receiver sheets.

Karino, in U.S. Pat. No. 5,112,720, discloses a color diffusion transfer film unit comprising (1) a support having a light-shielding function in itself and/or having thereon a layer having a light-shielding function; (2) a light sensitive element on the support comprising, in order from the support at least (a) a color image receiving layer, (b) a peeling layer, and (c) at least one silver halide emulsion layer associated with a color image-forming substance; (3) a light-shielding agent containing alkali processing composition; and (4) a cover sheet comprising at least a layer having a neutralizing function on a tranparent support, wherein said cover sheet is characterized by having a dye-trapping layer comprising a mrodant in a binder adjacent to the alkali processing composition.

Willis and Texter, in U.S. Ser. No. 7/804,877 filed Dec. 6, 1991, disclose a heat image separation system that uses conventional wet development of silver halide containing elements to create thermal dye diffusion images. Bleaching and fixing components of the wet development process are avoided, and the dye image is separated from the silver image by heat activated thermal transfer of the dye image to a polymeric receiving layer. Said images are subsequently further separated when the donor layers are stripped from the receiver layer.

Diffusible Dye Forming Compounds

The use of diffusible dyes in photographic image transfer systems is well known, as is the formation of diffusible dyes from nondiffusing dye forming compounds. Whitmore and Mader, in British Patent Specification Nos. 840,731 and 904,364 and in U.S. Pat. No. 3,227,550, discuss the use of such compounds in certain image transfer photographic systems. Their inventions utilized preferred diffusible dye forming compounds which may be described as couplers of the general structure R-Cp-R' where Cp is a coupler residue forming a dye with a p-phenylenedianiine or other developing agent, R is a removable substituent in the coupling position such as a ballast group rendering the coupler nondiffusing or a removable preformed dye molecule, and R' is a ballast group or a solubilizing group in a noncoupling position of the coupler residue. Either R or R' or both may contain solubilizing groups rendering the dye formed or split off during or after development diffusible in the photographic element wetted with processing solutions such as alkaline development solutions.

Dappen and Smith in U.S. Pat. No. 3,743,504 disclose the use of immobile diffusible-dye-forming couplers and immobile diffusible-dye-releasing couplers in a color diffusion transfer system.

Minagawa, Arai, and Ueda in U.S. Pat. No. 4,141,730 disclose the use of immobile colored coupling compounds which release diffusible dye during color development. These compounds are used to advantage in masking applications.

Sakanoue, Hirano, Adachi, Minami, and Kanagawa in German Offen. No. 3,324,533 Al, Booms and Holstead in U.S. Pat. No. 4,420,556, and Arakawa and Watanabe in European Patent Specification 115,303 B1 disclose the use of diffusible dye forming couplers to provide photographic materials with improved graininess.

Figueras and Stem disclose in U.S. Pat. No. 3,734,726 the use of substantially colorless m-sulfonamidoaniline and m-sulfonamidophenol compounds which react with oxidized color development agents to release a coupler moiety which couple with oxidized color developing agent to produce diffusible dye in color diffusion transfer elements and processes. Fleckenstein discloses in U.S. Pat. No. 3,928,312 and Fleckenstein and Figueras disclose in German Offen. No. 2,242,762, in U.S. Pat. No. 4,076,529 the use of p-sulfonamidoaniline, p-sulfonamidophenol, p-sulfonamidonaphthol, and related compounds which react with oxidized color development agents to release diffusible dyes in color diffusion transfer elements and processes.

Bloom and Stephens in U.S. Pat. Nos. 3,443,939 and 3,498,785, Bloom and Rogers in U.S. Pat. No. 3,443,940, and Bloom in U.S. Pat. No. 3,751,406 disclose the use of m-amidophenols, m-amidoanilines, and related compounds that release dyes or dye precursors upon reaction with oxidized color developer in color diffusion transfer units and processes.

Barrier Layers

Becker, in U.S. Pat. Nos. 3,384,483 and 3,477,849, discloses the use of a barrier layer comprising an alkali-permeable, water-insoluble polyvalent metal salt of a film-forming alkali-permeable, water-soluble polymeric carboxylic acid useful in preparing multicolor dye developer diffusion transfer images. The barrier layer functions to reduce color contamination of the transferred images by impeding the diffusion of the dye developer.

Kruck, in U.S. Pat. No. 3,885,969, discloses the use of a lyophobic barrier layer consisting of a salt of an acetate of polyvinylalcohol or of a hydroxyl-containing copolymer and an aldehyde sulfonic acid, between plasticized support layers and an antihalation layer, in dye image providing materials.

Cardone, in U.S. Pat. No. 3,888,669, discloses the use of barrier layers in multilayer and multicolor composite diffusion transfer film units. Said diffusion transfer film units comprise diffusible dye forming layers, a dye fixing layer or a dye mordanting layer, an opaque layer or means for producing an opacifying layer, a barrier layer impermeable to the diffusible dyes produced but permeable to a contacting processing composition, a dimensionally stable transparent layer adjacent to the barrier layer, means for interposing between said barrier layer and said adjacent dimensionally stable transparent layer a processing composition, and means for maintaining the composite film unit intact subsequent to diffusion transfer processing of the unit.

The use of spacer layers or timing layers as barrier layers to delay the function of neutralizing layers in diffusion transfer processes is described in U.S. Pat. Nos. 2,584,030, 3,419,389, 3,421,893, 3,433,633, 3,455,686, 3,592,645, 3,756,815, and 3,765,893, and in *Research Disclosure*, Vol. 123, July 1974, Item No. 1233 1, entitled *Neutralizing Materials in Photographic Elements*. Specific polymeric materials which have been demonstrated to be effective as barrier layers between dye image forming units have been disclosed in U.S. Pat. No. 3,384,483, 3,345,163, and 3,625,685.

The use of barrier layers during development in image diffusion transfer elements, particularly integral elements, to prevent diffusion of materials to the image receiving layer has been described by Buckler et al. in U.S. Pat. No. 3,679,409. Such barrier layers allow diffusion of image forming materials or products of such materials at high pH, such as the pH of the processing composition, prevent diffusion of such materials at low pH, and thereby prevent diffusion of the image forming materials after processing. Other means for forming barrier layers are disclosed in U.S. Pat. Nos. 3,576,626 and 3,597,197.

Hannie, in U.S. Pat. No. 4,056,394, discloses a timing layer which serves as a temporary barrier to penetration of alkaline processing solution. Said timing layer comprises 5 to 35 weight percent of polymerized ethylenically unsaturated monomer, 2 to 10 percent by weight of polymerized ethylenically unsaturated carboxylic acid, and 55 to 85 percent by weight of polymerized vinylidene chloride.

Brust et al., in U.S. Pat. No. 4,088,499, disclose a selectively permeable layer for diffusion transfer film units that is pH selectively permeable and comprises 0 to 100 mole percent of a polymerized monomer containing at least one active methylene group, from 0 to 90 mole percent of at least one additional hydrophilic polymerized ethylenically unsaturated monomer, and 0 to 80 mole percent of at least one additional hydrophobic polymerized ethylenically unsaturated monomer.

Abel, in U.S. Pat. Nos. 4,229,516 and 4,317,892, discloses a temporary barrier layer for use in color image transfer film units comprising a mixture of (1) 5 to 95 percent by weight of a copolymer comprising 55 to 85 percent by weight of vinylidene chloride, 5 to 35 percent by weight of an ethylenically unsaturated monomer, and 0 to 20 percent by weight of an ethylenically unsaturated carboxylic acid, and (2) from 5 to 95 percent by weight of a polymeric carboxy-ester-lactone.

Mizukura and Koyama disclose, in U.S. Pat. No. 4,407,938, the use of a lactone polymer and a vinylidene chloride terpolymer in formulating temporary barrier layers.

Helling et al., in European Patent Document No. 48,412, disclose the formulation of temporary barrier layers of reduced permeability for alkali using copolymers of acid containing, acid free, and cross-linking monomers.

Abel and Bowman, in U.S. Pat. No. 4,504,569, disclose a temporary barrier layer comprising N-alkyl substituted acrylamide and a polymerized crosslinking monomer wherein the polymer has a solubility parameter from 13° to 16° at 25° C. The barrier layer is useful as a process timing layer in color image transfer film units.

Hayashi et al., in U.S. Pat. No. 4,614,68 1, disclose the use of a copolymer, having ethylene and vinyl alcohol repeating units, as a barrier layer to oxygen diffusion.

Bowman and Verhow, in U.S. Pat. No. 4,865,946, disclose a temporary barrier layer comprising polymerizable monomers of certain acrylamides, crosslinking groups, and other ethylenically unsaturated monomers. Said barrier layers are useful in color image transfer units.

Holmes and Campbell, in U.S. Pat. No. 4,055,429, disclose a polymeric barrier layer for scavanging diffusible dyes.

Stripping Layers

Land, in U.S. Pat. No. 3,220,835, discloses a stripping layer in a silver halide diffusion transfer process. Said stripping layer may comprise gum arabic, sodium alginate, pectin, cellulose acetate hydrogen phthalate, polyvinyl alcohol, hydroxyethyl cellulose, polymethacrylic acid, plasticized methyl cellulose, ethyl cellulose methyl methacrylate, or butyl methacrylate. Said process comprises an assemblage wherein alkaline processing fluid is distributed intermediate the photosensitive silver halide layers and the receiving layers.

Dannhauser, in U.S. Pat. No. 3,730,718, discloses a dye diffusion transfer process which comprises a multilayer material comprising a stripping layer. Said stripping layer is arranged intermediate the diffusible dye forming layers and the image receiving layer. After development the stripping layer should provide for easy separation between the dye receiving layers and the diffusible dye forming layers. The stripping layer therefore should consist of a material which is soluble in the aqueous alkaline processing solution or becomes soft in this solution. Water soluble or alkali soluble derivatives of cellulose or related materials such as hydroxyethyl cellulose, cellulose acetate hydrogen phthalate, and sodium alginate. Water soluble synthetic polymers such as polyvinyl alcohol are also suitable.

Tsuji et al., in U.S. Pat. No. 3,820,999, disclose the use of polyaddition products of bisacrylamides and diamines in formulating improved stripping layers for silver halide diffusion transfer processes.

Bishop et al., in U.S. Pat. No. 4,459,346, disclose the use of certain straight chain alkyl or polyethylene oxide perfluoroalkylated esters and perfluoroalkylated ethers as stripping agents in diffusion transfer assemblages. These stripping agents were examined with respect to their performance in dry stripping and compared with other stripping agents such as hydroxyethyl cellulose, perfluoronated alkyl-polyoxyethylene ether, ethoxylated fluoroalkyl nonionic surfactant, Aerosol TR (sodium bis[tridecyl]sulfosuccinate), polyethylene glycol, and various other anionic and nonionic fluoroalkyl surfactants. Similar agents have been described as release agents by Vanier in U.S. Pat. No. 4,740,496. Such release agents have been used to aid the release of dye-donor and dye-receiver elements in thermal dye transfer assemblages. Cope and Chaikin, in U.S. Pat. No. 3,779,768, disclose the use of such agents in vesicular films to improve sensitivity while maintaining small vesicle size. Bloom and Rogers, in U.S. Pat. No. 3,806,346, disclose the use of the ammonium salt of perfluorooctanoic acid in an integral diffusion transfer film unit to suppress triboluminescence during stripping. Sugimoto et al., in U.S. Pat. No. 4,267,265, disclose the use of organic fluoro-compounds in surface layers of photographic materials to improve anti-adhesion and anti-static properties of such materials.

Wright, in U.S. Pat. No. 4,328,301, discloses stripping layers in diffusion transfer elements wherein said layers comprise graft copolymers of gelatin. Such stripping layers purportedly exhibit good dry adhesion to emulsion layers and moderate wet adhesion to mordant layers. Katoh, in U.S. Pat. No. 4,629,677, discloses stripping layers in diffusion transfer elements, wherein said layers comprise copolymers having more than 40 mole percent of a monomer unit derived from an ethylenically unsaturated carboxylic acid. Hayashi et al., in U.S. Pat. No. 4,728,595, disclose stripping layers in diffusion transfer elements formulated with light-reflective organic polymers.

Mordants

Klein et al., in U.S. Pat. No. 4,450,224, disclose polymers comprising repeating units derived from $\alpha,\beta$-ethylenically unsaturated monomers, acrylonitrile or methacrylonitrile repeating units, alkyl substituted imidazole repeating units, and similar imidazolium repeating units. Nakamura et al., in U.S. Pat. No. 4,594,308 and in European Patent Specification 144,059 B1, disclose polymeric mordants comprising a monomer unit having an imidazole ring and comprising a monomer unit having a sulfinic acid group. Said mordants provide improved light and thermal stability for dyes attached thereto. Aono et al., in U.S. Pat. No. 4,619,883, disclose the use of terpolymers as dye fixing materials, wherein said terpolymers comprise imidazole and imidazolium repeating units. Aono et al., in U.S. Pat. No. 4,636,455, disclose a variety of polymeric mordants suitable for use as dye fixing materials in diffusion transfer systems. Such polymers typically contain vinyl monomer units having tertiary amino groups or quaternary amino groups. Nakamura et al., in U.S. Pat. No. 4,766,052, disclose polymeric mordants which comprise imidazole containing repeating units and comprising repeating units from at least one of three types of modified ethylenic groups. Shibata and Hirano, in U.S. Pat. No. 4,774,162, disclose polymeric mordants which comprise imidazole ring containing repeating units and comprising repeating units derived from at least one of three types of alkoxide modified ethylenic groups.

Yamanouchi et al., in U.S. Pat. No. 5,023,162, disclose polymeric mordants that comprise dye stabilizing repeating units in addition to tertiary amino or quaternary ammonium salt repeating units for dye fixing.

Problems with Prior Art

Bleach-fix solutions commonly contain iron, ammonium, ethylenediaminetetraacetic acid, thiosulfate and, after use, silver. These components of 3∂wet" silver halide processing are the source of much of the pollution from photofinishing processes.

Photographic elements containing image-transfer diffusible dyes, when processed in developer baths of the type normally encountered in the photofinishing trade, suffer from a high degree of dye washout. This washout represents a major inefficiency in dye utilization, since the dye which washes out into the developer solution or other processing solution is no longer available to provide a dye image in the photographic element. Furthermore, this washout results in severe seasoning of the developer baths and in the unwanted accumulation of precipitates in low pH stop and bleaching baths.

Heat image separation systems, comprising wet development and thermal dye diffusion transfer, achieve significant reductions in processing effluent, but require a separate thermal processing step and excessively lengthy thermal activation in order to obtain desired levels of transferred dye density.

These and other problems may be overcome by the practice of our invention.

DISCLOSURE OF INVENTION

It is an object of our invention to reduce the amount of waste processing solution effluents generated by the overall processing system while retaining the benefits of image quality and industry compatibility which are derived from wet development with conventional developing solutions.

An object of the present invention is to provide a chromogenic photographic material with a high density and low fog image. A further object of the present invention is to provide improved image dye retention in the photographic element. Another object of the present invention is to provide a color diffusion image separation system that does not require excessive heating of the imaging elements. Yet another object of the present invention is to minimize the seasoning of processing solutions with diffusible dyes.

In accordance with this invention a diffusion transfer process is provided for forming a color photographic image comprising the steps of: (a) using an integral element comprising one and only one dimensionally stable layer comprising a coating support, and coated thereon in reactive association a mordant layer comprising a material which binds a diffusible dye, an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer that allows the passage of solutions for processing said element when said element is contacted with an external processing bath, and wherein said barrier layer impedes the diffusion out of said element of the diffusible dye formed from said diffusible dye forming compound; (b) exposing said element to actinic radiation; (c) processing said element by contacting said element to an external bath containing compounds selected from the group consisting of conventional color developer compounds of the primary an-fine type, compounds which activate the release of incorporated color developers, and compounds which activate development by incorporated dye developers; (d) washing said element to remove compounds imbibed in step (c). In a preferred embodiment said integral element further comprises a stripping layer coated intermediate the mordant layer and dye forming layer. In another preferred embodiment said process further comprises the step of stripping said mordant and support from said diffusible dye forming layer.

MODES FOR CARRYING OUT THE INVENTION

Figure 1:
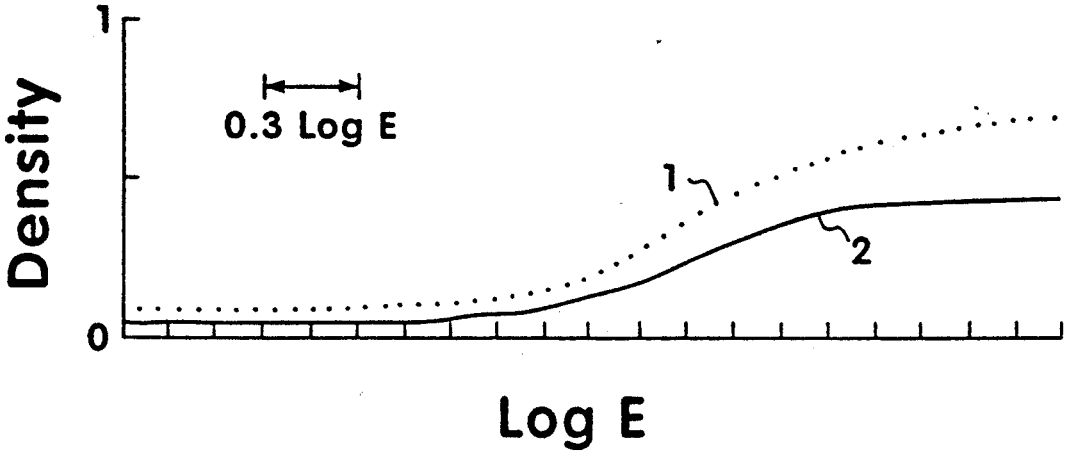
FIG. 1. Sensitometry (status A densitometry) obtained for coating of coupler Y1 (351 CIS) processed as described in Example 1; curve 1—bleached and fixed integral element; curve 2—receiver element.
Figure 2:
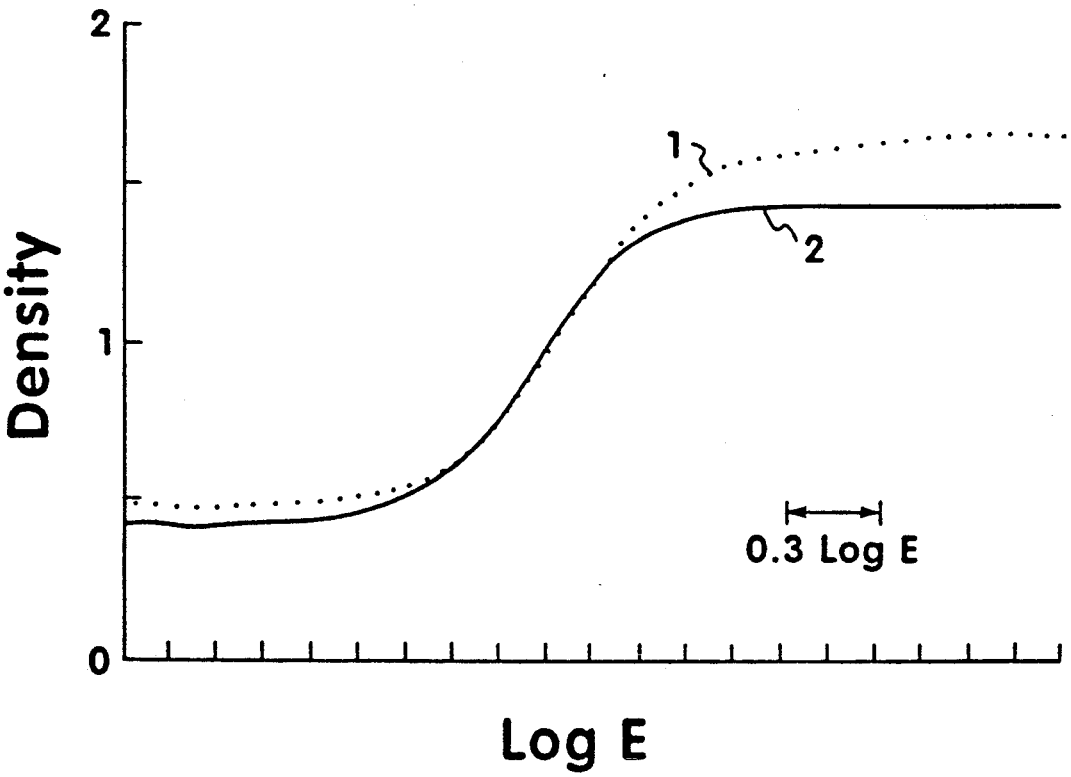
FIG. 2. Sensitometry (status A densitometry) obtained for coating of coupler Y2 (35 1XT) processed as described in Example 2; curve 1—bleached and fixed integral element; curve 2—receiver element.
Figure 3:
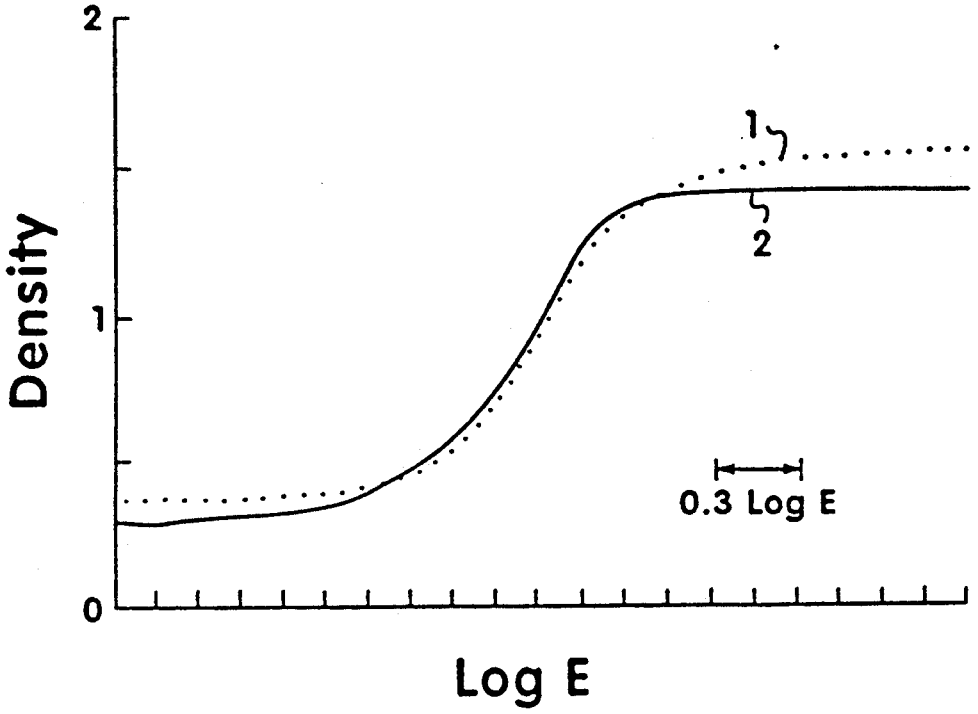
FIG. 3. Sensitometry (status A densitometry) obtained for coating of coupler Y3 (3 8 1 HEI) processed as described in Example 3; curve 1—bleached and fixed integral element; curve 2—receiver element.
Figure 4:
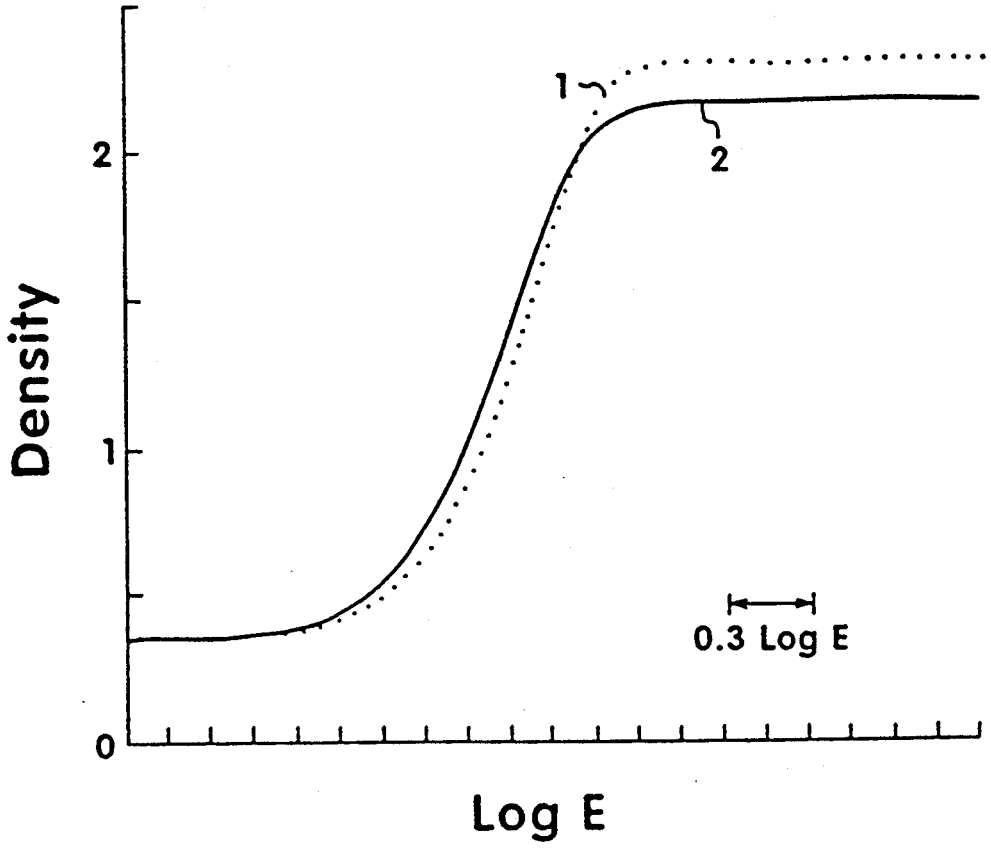
FIG. 4. Sensitometry (status A densitometry) obtained for coating of coupler C (1 14AHZ) processed as described in Example 4; curve 1—bleached and fixed integral element; curve 2—receiver element.
Figure 5:
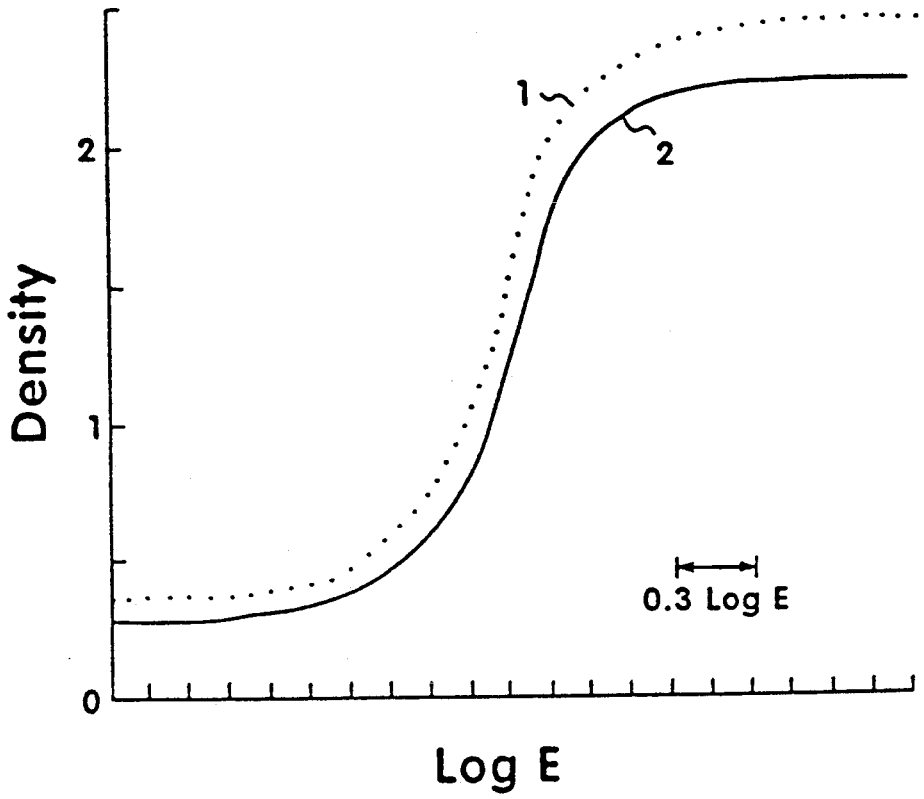
FIG. 5. Sensitometry (status A densitometry) obtained for coating of coupler M (241CG) processed as described in Example 5; curve 1—bleached and fixed integral element; curve 2—receiver element.

The term "nondiffusing" used herein as applied to the couplers and diffusible dye forming compounds has the meaning commonly applied to the term in color photography and denotes materials which for all practical purposes do not migrate or wander through organic colloid layers, such as gelatin, comprising the sensitive elements of the invention. The ten-n "diffusible" as applied to dyes formed from these "nondiffusing" couplers and compounds in the processes has the converse meaning and denotes materials having the property of diffusing effectively through the colloid layers of the sensitive elements in the presence of the "nondiffusing" materials from which they are derived.

Preferred diffusible dye forming compounds are of various types. Particularly preferred are compounds of the type $$\text{Dye-Y-Cp-D-B} \qquad \text{(I)}$$

where D is a photographically inert linkage joining a ballast group B to a coupler residue Cp in a noncoupling position and Y is a splittable linkage, such as an azo group, attaching the diffusible dye moiety (Dye) to the coupler residue in the coupling position. Such compounds are nondiffusing couplers having a removable solubilized preformed azo or other dye-forming moiety in the coupling position through a linkage which is split during development leading to the formation of a dye diffusible in layers wetted with processing solutions, and, when necessary because of the diffusible nature of the molecule, a ballast group in a noncoupling position rendering the compound nondiffusing.

Preferred also are compounds of the type $$\text{B-Y-Cp-D-R} \qquad \text{(II)}$$

where D is a photographically inert linkage joining the solubilizing group R to the coupler moiety Cp in a noncoupling position, and Y is a splittable linkage joining the ballast group B to the coupler residue in the coupling position. These nondiffusing couplers have a removable ballast group that renders the coupler nondiffusing until the ballast is split off during development and a solubilizing group in a noncoupling position that imparts diffusibility to the dye obtained in photographic processing solutions such as alkaline developing solutions.

Preferred photographically inert linkages, D, include —N=N—, —O—, —Hg—, >CH—, =CH—, —S—, —S—S—. Other preferred inert linkages include those disclosed in British Patent Specification No. 904,364 on page 4 in lines 6 through 12, and are incorporated herein by reference.

The acidic solubilizing radicals attached to the diffusible dye forming compounds described above can be solubilizing radicals which when attached to the coupler or developer moieties of the dyes, render the dyes diffusible in alkaline processing solutions. Preferred solubilizing groups which render the dyes diffusible in alkaline processing solutions include —$SO_3H$, —$CH_2OH$, —$C_2H_4OH$, —$CH(OH)CH_2OH$, —$PO_3H_2$, —$AsO_3H_2$, —COOH, and —$SO_2NH_2$.

Preferred dye radical substituents include azo, azomethine, indoaniline, indophenol, anthraquinone, and related dye radicals well known in the art that exhibit selective absorption in the visible spectrum. The dye radicals contain acidic solubilizing moieties.

The nature of the ballast groups in the coupler compounds is not especially critical as long as the groups confer nondiffusibility to the coupler compounds and do not have a character such that the diffusible dyes are prevented from being formed through reaction with the developer. Typical ballast groups exemplified hereinafter in the specific couplers disclosed include long chain alkyl radicals linked directly or indirectly to the coupler molecules by a splittable linkage or by a removable or irremovable but otherwise nonfunctional linkage depending upon the nature of the coupler compound. Preferred ballast groups have eight or more carbon atoms. Examples of preferred ballast groups B1--B34 are listed in Table 1. In these groups $R_1$ is long or short chain alkyl or aralkyl, $R_2$ and $R_3$ are long or short chain alkyl, $R_4$ is substituted or unsubstituted alkyl or aryl, and $X_1$ represents hydrogen,

TABLE 1

| Ballast Groups | |
|---|---|
| 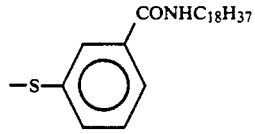 | B1 |
| 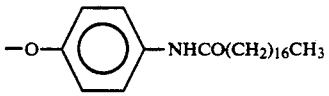 | B2 |
| 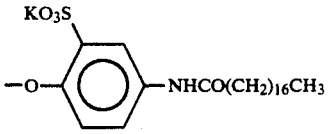 | B3 |
| 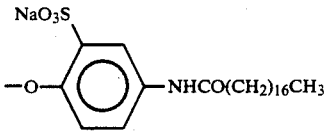 | B4 |

TABLE 1-continued

| Ballast Groups | |
|---|---|
| 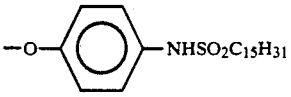 | B5 |
| 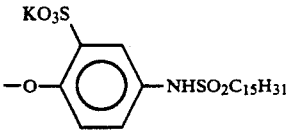 | B6 |
| 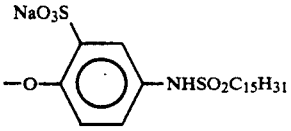 | B7 |
| 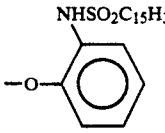 | B8 |
| 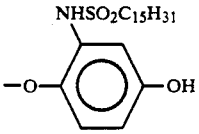 | B9 |
| 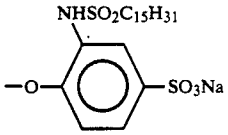 | B10 |
| 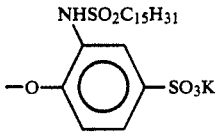 | B11 |
| 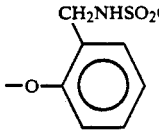 | B12 |
| 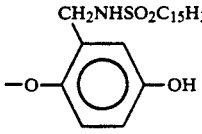 | B13 |
| 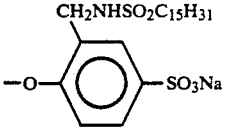 | B14 |
| 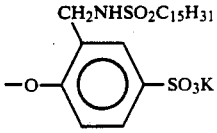 | B15 |

TABLE 1-continued

| Ballast Groups | |
|---|---|
| 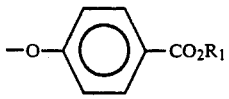 | B16 |
| 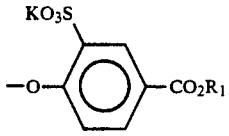 | B17 |
| 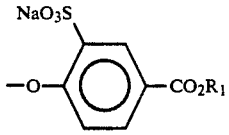 | B18 |
| 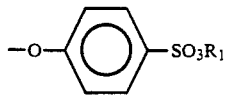 | B19 |
| 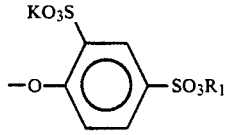 | B20 |
| 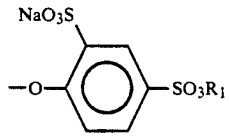 | B21 |
| 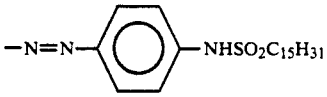 | B22 |
| 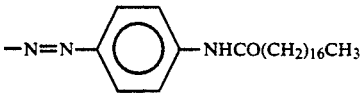 | B23 |
| 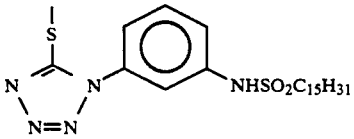 | B24 |
| 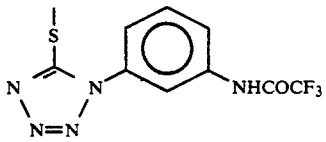 | B25 |
| 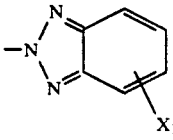 | B26 |
| 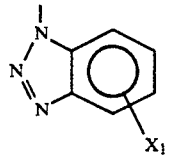 | B27 |
| 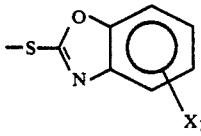 | B28 |
| 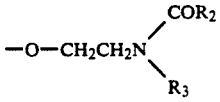 | B29 |
| 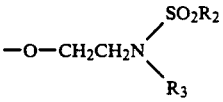 | B30 |
| $-S-(CH_2)_n-CO_2R_2$ | B31 |
| $-NHSO_2R_4$ | B32 |
| 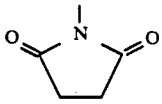 | B33 |
| 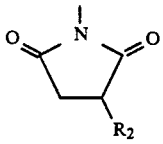 | B34 |

alkyl, alkoxy, halogen, $-CO_2R_5$, $-NHSO_2R_5$, $-NHCOR_5$, where $R_5$ is long or short chain alkyl. It will be understood by one skilled in the art that these illustrated ballast groups are representative and not exclusive.

The coupler residues in the above structures I and II are well known in the photographic art, as are the corresponding coupling positions. 5-Pyrazolone coupler radicals couple at the carbon atom in the 4-position; phenolic coupler radicals, including, α-naphthols, couple at the carbon atom in the 4-position; open chain ketomethylene coupler radicals couple to the carbon atom forming the methylene moiety, for example, the C atom in the $-CO-CH_2-CO-$ group. Preferred examples of diffusible dye forming compounds are disclosed in British Patent Specification No. 904,364 on pages 6 through 14 as compound I through XXX and are incorporated herein by reference. Preferred examples of diffusible dye forming compounds are disclosed in U.S. Pat. No. 3,227,550 in columns 4 through 17 as compound 1 through LV and are incorporated herein by reference. Preferred examples of diffusible dye forming compounds designated as couplers Y-1 through Y-15, M-1 through M- 15, and C- 1 through C- 19 are disclosed in European Patent Specification No. 115,303 B 1 of Arakawa and Watanabe on pages 9–23 of the published specification and in German Offen. No. 3,324,533 A1 of Sakanoue et al. on pages 20–41 and are incorporated herein by reference. Preferred examples of diffusible dye releasing couplers are disclosed in U.S. Pat. No. 4,141,730 of Mimagawa et al. as Compounds 1-35 in columns 5-20 of the specification and are incorporated herein by reference.

Other preferred diffusible dye forming compounds are of the type

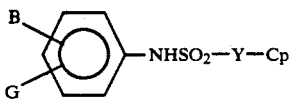

(III)

wherein Cp is a photographic coupler moiety capable of reacting with oxidized aromatic primary amino color developing agent to produce diffusible dye or diffusible dye radical or diffusible dye precursor, B— is a ballast radical as described above, and —G is —OR or —$NR_1R_2$ wherein R is hydrogen or a hydrolyzable moiety and $R_1$ and $R_2$ are each hydrogen or an alkyl group, and —Y— is a divalent linking group. It is particularly preferred in the compounds of structure M that $R_1$ and $R_2$ are alkyl groups having 8 to 22 carbon atoms. Preferred examples of diffusible dye forming compounds according to structure III are disclosed by Figueras and Stem in U.S. Pat. No. 3,734,726 (May 22, 1973) in column 5 and designated as compounds 1 through 6 and are incorporated herein by reference. Other preferred examples of diffusible dye forming compounds according to structure III are disclosed by Fleckenstein and Figueras in German Patent No. 2,242,762 (May 22, 1973) on pages 21-49 and designated as compounds I through XLV and are incorporated herein by reference.

Further preferred are diffusible dye forming compounds of the type

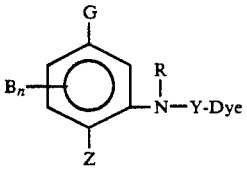

(IV)

wherein $B_n$ is one or more photographically inert organic ballasting radicals of such molecular size and configuration as to render said molecule nondiffusible during development in alkaline color developing solution; G is an —OR′ or —$NR_1R_2$ radical wherein R′ is hydrogen or a hydrolyzable moiety and $R_1$ and $R_2$ are each hydrogen or an alkyl group; Z is hydrogen or is selected from the group consisting of radicals replaceable by oxidized aromatic amino color developer; R is hydrogen, alkyl, or substituted alkyl; Y is a divalent linking radical linking selected from the group consisting of an azo radical, a mercuri radical, an oxy radical, an alkylidene radical, a thio radical, a dithio radical, and an azoxy radical; Dye is a dye radical or dye precursor. Preferred examples of compounds according to formula V have been disclosed in columns 5-7 of U.S. Pat. No. 3,443,939 (May 13, 1969) of Bloom and Stephens and designated as compounds 1-9, and are incorporated herein by reference.

Additionally preferred are diffusible dye forming compounds of the type

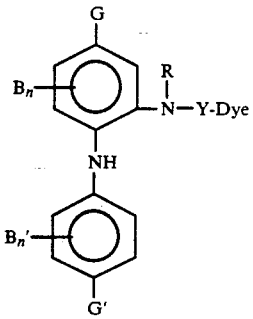

(VI)

wherein $B_n$ and $B'_n$ each represent a photographically inert organic ballasting radicals of such molecular size and configuration as to render said molecule nondiffusible during development in alkaline color developing solution; G and G′ each is hydrogen, hydroxy, —OR′, or —$NR_1R_2$ radical wherein R′ is a hydrolyzable moiety and $R_1$ and $R_2$ are each hydrogen or an alkyl group provided at least one of G and G′ is hydroxy or amino; R is hydrogen, alkyl, or substituted alkyl; Y is a divalent linking radical linking selected from the group consisting of an azo radical, a mercuri radical, an oxy radical, an alkylidene radical, a thio radical, a dithio radical, and an azoxy radical; Dye is a dye radical or dye precursor. Preferred examples of compounds according to formula V have been disclosed in columns 7-13 of U.S. Pat. Nos. 3,443,939 (May 13, 1969) and 3,498,785 (Mar. 3, 1970) of Bloom and Stephens and designated as compounds 1-23, and in columns 9-13 of U.S. Pat. No. 3,751,406 (Aug. 7, 1973) of Bloom as compounds designated 9-31, and are incorporated herein by reference.

Couplers according to formulae I, II, and III may be synthesized by methods well known in the art. In particular, diffusible dye-forming compounds according to structures I and II may be synthesized according to methods detailed in British Patent Specifications 840,731 (Jul. 6, 1960) and 904,364 (Aug. 29, 1962) of Whitmore and Mader, in U.S. Pat. No. 3,227,550 (Jan. 4, 1966) of Whitmore and Mader, in U.S. Pat. No. 4,141,730 (Feb. 27, 1979) of Minigawa et al., in U.S. Pat. No. 4,420,556 (Dec. 13, 1983) of Booms and Holstead, in German Offen. No. 3,324,533 A1 (Jan. 12, 1984) of Sakanoue et al., and in European Patent Specification No. 115,303 B 1 (Oct. 4, 1989) of Arakawa and Watanabe, the disclosures of which are incorporated herein by reference. Compounds of formulae I and II may be synthesized, for example, by using methods described in U.S. Pat. Nos. 3,227,554, 4,264,723, 4,301,235, and 4,310,619 and in Japanese Patent Applications (OPI) 1938/81, 3934/82, 4044/82, 105226/78, 122935/75, and 126833/81. Compounds according to formula III may be synthesized by methods described in U.S. Pat. Nos. 3,734,726 (May 22, 1973) of Figueras and Stem, 3,928,312 (Dec. 23, 1975) of Fleckenstein, and 4,076,529 (Feb. 28, 1978) of Fleckenstein and Figueras, and in German Patent No. 2,242,762 Mar. 8, 1973) of Fleckenstein and Figueras. Compounds according to formulae IV and V may be synthesized by methods described or referenced in U.S. Pat. Nos. 3,443,939 (May 13, 1969) and 3,498,785 (Mar. 3, 1970) of Bloom and Stephens and 3,751,406 (Aug. 7, 1973) of Bloom.

Color developing agents which are useful with the nondiffusing couplers and compounds of this invention include the following:

4-amino-N-ethyl-3-methyl-N-β-sulfoethyl)aniline
4-amino-N-ethyl-3-methoxy-N-(β-sulfoethyl)aniline
4-amino-N-ethyl-N-(β-hydroxyethyl)aniline
4-amino-N,N-diethyl-3-hydroxymethyl aniline
4-amino-N-methyl-N-(β-carboxyethyl)aniline
4-amino-N,N-bis-(β-hydroxyethyl)aniline
4-amino-N,N-bis-(β-hydroxyethyl)-3-methyl-aniline
3-acetamido-4-amino-N,N-bis-(β-hydroxyethyl)aniline
4-amino-N-ethyl-N-(2,3-dihydroxypropoxy)-3-methyl aniline sulfate salt
4-amino-N,N-diethyl-3-(3-hydroxypropoxy)aniline Certain polymers of this invention can be used as barrier layers to diffusible dyes and their precursors. The barrier polymers of this invention contain ion forming functional groups in amounts from about $1\times10^{-5}$ to about $4\times10^{-3}$ moles/gram of polymer and preferably from about $5\times10^{-5}$ to about $2\times10^{-3}$ moles/gram of polymer. Additionally, the barrier polymers of this invention do not contain groups which significantly absorb, scavenge, or mordant diffusible dyes, for example, secondary, tertiary, or quaternary ammonium groups. The polymer should contain a balance of hydrophobic and hydrophilic entities such that they are swellable, but not fully soluble in water or processing solutions as coated. They should also allow the passage of processing solutions, either when coated alone or in combination with gelatin. Further, they should be dispersible or soluble in water as formulated for coating. The preferred polymers are cationic. The molecular weight of the polymers must be such that they are practical to coat, and is preferably 50,000 to 1,000,000.

The polymers may contain repeating units derived from any monomers which can be used in photographic elements provided the resulting polymer meets the ionic content requirement defined above and has the correct water swellability in the processing solutions. These can include, among others, water dispersible polyesters, polyamides, polyethers, polysulfones, polyurethanes, polyphosphazenes, and chemically modified naturally-occurring polymers such as proteins, polysaccharides, and chitins. Preferred monomers are vinyl monomers, particularly acrylate, methacrylate, acrylamide and methacrylamide monomers which includes analogs of said monomers.

The more preferred polymers contain repeating units of the formula —(A)—(B)— wherein A is a hydrophobic ethylenically unsaturated monomer and B is an ionic hydrophilic ethylenically unsaturated monomer. A may be selected from, for example, vinyl ketones, alkylvinyl esters and ethers, styrene, alkylstyrenes, halostyrenes, acrylonitrile, butadiene, isoprene, chloroprene, ethylene and alkyl substituted ethylenes, alkyl substituted acrylaniides, alkyl substituted methacrylamides, haloethylenes, and vinylidene halides. Examples of hydrophobic monomers are listed in *Research Disclosure* No. 19551, p. 301, July, 1980 hereby incorporated by reference. B may be selected from any class of vinyl monomers having an ion forming functional group and that can undergo free radical polymerization, for example, itaconic and fumaric acids, vinyl ketones, N-vinyl amides, vinyl sulfones, vinylethers, vinylesters, vinyl urylenes, vinyl urethanes, vinyl nitriles, vinylanhydrides, allyl amine, maleic anhydride, maleimides, vinylimides, vinylhalides, vinyl aldehydes, substituted styrenes, and vinyl heterocycles. Other examples of ionic monomers are listed in *Research Disclosure* No. 1955 1, p. 303, July 1980 hereby incorporated by reference. The more preferred monomers of group A and B are acrylamides, methacrylamides, acrylates, and methacrylates.

The ion forming functional groups of B may be ionic groups, ion forming functional groups or groups which can undergo a subsequent reaction resulting in the formation of an ionic group, e.g. by hydrolysis or by pH induced protonation. Any ion forming functional group will work in this invention provided its presence augments the water swellability of the polymer during processing. Suitable ion forming groups will be apparent to those skilled in the art. The ion forming groups can be either cationic or anionic and the polymers may contain monomers with opposite charges such that the polymers are zwitterionic.

Particularly useful are polymers containing repeating units derived from ethylenically unsaturated monomers of the formula $-(A)_m-(B)_n-$.

A is a hydrophobic monomer having structure

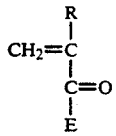

where R is hydrogen or methyl; E is $-OR_2$ or $-NR_3R_4$; $R_2$ is a substituted or unsubstituted straight, branched, or cyclic alkyl or aryl group of about 1 to 10 carbon atoms; $R_3$ and $R_4$ are independently selected from hydrogen or any $R_2$ group and $R_3$ and $R_4$ together contain at least 3 carbon atoms; and m is 0 to 99.5 mole percent. B is an ionic hydrophilic monomer of the formula

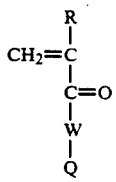

wherein R is hydrogen or methyl; W is $-OR_5$ or $-NR_6R_7$; $R_5$ is a straight, branched, or cyclic alkylene or arylene group of 1 to about 10 carbon atoms; $R_6$ is hydrogen or a straight, branched, or cyclic alkyl or aryl group from 1 to about 6 carbon atoms; $R_7$ is a straight, branched or cyclic alkylene or arylene group of 1 to about 10 carbon atoms, n is 0.5 to 100 mole percent; and Q is an ionic functional group independently selected from:

(a) $-NH_2$ or the acid addition salt $-NH_2$:HX, where X is an appropriate acid anion or
(b) $-CO_2M$, $-SO_3M$, $-OSO_3M$, $-OPO_3M$, and —OM where M is an appropriate cation.

When the polymers of this invention are derived from monomers A and B of the above formula and both A and B are acrylamide or methacrylamide monomers monosubstituted on the amide nitrogen the polymers fall within a class of polymers known as Thermo Reversible Gelling (TRG) polymers. The TRG polymers are one preferred class of polymers in this invention and are described in detail in U.S. application Ser. No. 502,726 filed Apr. 2, 1990, hereby incorporated by reference. Any TRG polymer as described in the above application is included in this invention providing it falls within the parameters described herein.

$R_2$, $R_3$, and $R_4$ of formula A may be substituted with any non-ion forming group that does not interfere with the hydrophobic nature of the monomer or prevent polymerization. Examples of substituents are halide, alkoxy, acryloxy, styryl, sulfoxyalkyl, sulfoalkyl, nitro, thio, keto, or nitrile groups. The monomers of group A may also contain reactive functional groups so that the polymers may perform other photographically useful functions common to interlayers between imaging layers and protective layers over imaging layers. $R_2$, $R_3$, $R_4$, $R_5$, $R_6$ and $R_7$ may be substituted with groups that can form heterocyclic rings. The straight, branched or cyclic alkyl groups of A and B include all isomeric forms and may contain one or more sites of unsaturation. The more preferred monomers of group A contain unsubstituted straight or branched alkyl groups of 4 to 8 carbon atoms and the more preferred monomers of group B contain straight or branched alkyl groups of 3 to 8 carbon atoms. The most preferred monomers of both A and B are acrylamides or methacrylamides monosubstituted on the amide nitrogen. For the polymers of this invention m is 0 to about 99.5 mole percent and n is about 0.5 to 100 mole percent. When the polymer is a TRG polymer m is preferably about 40 to 99 mole percent and n is preferably about I to about 60 mole percent.

The acid ions and cations of Q may be organic or inorganic. Appropriate anions include, but are not limited to, $Cl^-$, $Br^-$, $ClO_4^-$, $I^-$, $F^-$, $NO^-$, $HSO_4^-$, $SO_4^{2-}$, $HCO_3$, *and* $CO_3^{2-}$ with $Cl^-$ being most preferred. Appropriate cations include, but are not limited to, $H^+$, alkali metal, and ammonium, with $Na^+$ and $H^+$ being most preferred.

Examples of preferred monomers from group A are N-isopropylacrylamide, N-t-butylacrylamide, N-butylacrylamide, N-t-butylmethacrylamide, N-(1,1-dimethyl-3-oxobutyl)-acrylamide, N-butylmethacrylate, 2-ethyl-hexylmethacrylate, and benzylmethacrylate. Examples of preferred monomers from group B are N-(3-aminopropyl)methacrylamide hydrochloride, aminoethylmethacrylate hydrochloride, sulfo-ethyl methacrylate sodium salt, N-(2-sulfo-1,1-dimethyl-ethyl)acrylamide sodium salt and N-2-carboxyethylacrylamide.

The barrier polymers of this invention may also include repeating units derived from hydrophilic nonionic monomers to enhance their water swellability and to increase their permeability to processing solutions provided that ionic functional groups continue to comprise at least $1\times10^{-5}$ moles/gram of polymer. Any hydrophilic monomer that will undergo free radical polymerization is suitable provided it does not contain secondary, tertiary, or quaternary ammonium groups. Preferred monomers are ethylenically unsaturated monomers, for example, N-vinyl pyrrolidone, N-vinyl-ecaprolactam, vinyloxazolidone, vinyl menthyloxazolidone, maleimide, N-methylol-maleimide, maleic anhydride, N-vinylsuccinaniide, acryloylurea, cyanomethylacrylate, 2-cyanoethyl acrylate, glycerylacrylate, acryloyloxypolyglycerol, allyl alcohol, vinyl benzyl alcohol, p-methanesulfonamidostyrene, and methylvinylether. Block copolymers formed from, for example, polymethylene oxide, polypropylene oxide, and polyurethanes, with acrylate or methacrylate end groups can also be used. The more preferred monomers are acrylate, methacrylate, acrylamide and methacrylamide monomers and their analogs.

Representative monomers include N-(isobutoxymethyl)acrylamide, methyl-2-acrylamide-2-methoxy acetate, N-hydroxypropylacrylamide, ethylacrylamidoacetate, N-acetamidoacrylamide, N-(m-hydroxyphenyl)-acrylamide, 2-acrylamide-2-hydroxymethyl-1,3-propane diol, and N-(3- or 5-hydroxymethyl-2-methyl-4-oxo-2-pentyl)acrylamide. Other suitable hydrophilic monomers are listed in *Research Disclosure* No. 19551, p.305, July 1980 hereby incorporated by reference. Examples of preferred hydrophilic nonionic monomers are acrylamide, methacrylamide, N,N-dimethylacrylamide, hydroxyethylacrylanmde, hydroxyethyl acrylate, hydroxyethylmethacrylate, hydroxypropyl acrylate, hydroxypropylmethacrylate, and methylene-bis-acrylamide. The hydrophilic nonionic monomer may be 0 to about 70 mole percent and preferably about 10 to 65 mole percent.

The barrier polymer layers must also have enough physical integrity to survive processing intact. Those skilled in the art will recognize that many of the monomers discussed above contain structural elements that will meet this parameter. For example polymers containing the cationic hydrophilic monomer N-(3-aminopropyl)-methacrylamide hydrochloride also crosslink in the presence of many gelatin hardeners. Barrier polymers of this invention, however, may also contain additional monomers having groups which can be crosslinked by conventional photographic gelatin hardeners. These monomers can include, but are not limited to, aldehydes, bis(vinylsulfonyl)compounds, epoxides, aziridines, isocyanates, and carbodimides. Preferred are monomers containing active methylene groups such as 2-acetoacetoxyethylmethacrylate, ethylmethacryloylacetoacetate, and N-2-acetoacetoxyethyl)-acrylamide. Alteratively, di- or multi-functional monomers such as methylene-bisacrylamide or ethylene glycol-dimethacrylate may be used, whereby polymers are prepared as crosslinked colloidal particles that are swellable and dispersible in water. Barrier polymer examples of this invention are comprised of monomers whose structures are shown below in Table 2, and are listed in Table 3 which provides the monomer feed ratios used, charge type, and also indicates which of the polymers are of the preferred TRG class.

TABLE 2

| Monomers for Barrier Layer Polymers |
|---|
| $CH_2{=}C(XX)(YY)$ |
| Hydrophoic Monomers |
| IPA (N-isopropylacyrlamide) |
| XX = —H |
| YY = —(CO)—(NH)—$CH(CH_3)_2$ |
| TBA (N-t-butylacylamide) |
| XX = —H |
| YY = —(CO)—(NH)—$C(CH_3)_3$ |
| NBA (N-butylacrylamide) |
| XX = —H |
| YY = —(CO)—(NH)—$C_4H_9$ |
| TBMA (N-t-butylmethacrylamide) |
| XX = —$CH_3$ |
| YY = —(CO)—(NH)—$C(CH_3)_3$ |
| DOA (N-(1,1-dimethyl-3-oxobutyl)-acrylamide) |
| XX = —H |
| YY = —(CO)—(NH)—$C(CH_3)_2$—$CH_2$—(CO)—$CH_3$ |
| NBM (N-butylmethacrylate) |
| XX = —$CH_3$ |
| YY = —(CO)—O—$C_4H_9$ |
| 2EHM (2-ethyl-hexylmethacrylate) |
| XX = —$CH_3$ |
| YY = —(CO)—O—$CH_2CH(C_2H_5)CH_2CH_2CH_2CH_3$ |

TABLE 2-continued

| Monomers for Barrier Layer Polymers |
|---|
| $CH_2{=}C(XX)(YY)$ |
| BZM (benzylmethacrylate) |
| XX = $-CH_3$ |
| YY = $-(CO)-O-CH_2$-phenyl |
| AAM (2-acetoacetoxyethylmethacrylate; a crosslinker) |
| XX = $-CH_3$ |
| YY = $-(CO)-O-CH_2CH_2-O-(CO)-CH_2-(CO)-C_4H_{9-n}$ |
| Neutral Hydrophilic Monomers |
| A (acrylamide) |
| XX = $-H$ |
| YY = $-(CO)-NH_2$ |
| HEM (hydroxyethylmethacrylate) |
| XX = $-CH_3$ |
| YY = $-(CO)-O-CH_2CH_2OH$ |
| MBA (methylene-bis-acrylamide; difunctional) |
| $CH_2{=}CH-(CO)-(NH)-CH_2-(NH)-(CO)-CH{=}CH_2$ |
| Cationic Hydrophilic Monomers |
| APM (N-(3-aminopropyl)methacrylamide hydrochloride) |
| XX = $-CH_3$ |
| YY = $-(CO)-(NH)-CH_2CH_2CH_2NH_3{+}Cl^-$ |
| AEM (aminoethylmethacrylate hydrochloride) |
| XX = $-CH_3$ |
| YY = $-(CO)-O-CH_2CH_2NH_3{+}Cl^-$ |
| Anionic Hydrophilic Monomers |
| SEM (sulfoethylmethacrylate sodium salt) |
| XX = $-CH_3$ |
| YY = $-(CO)-O-CH_2CH_2SO_3{-}Na^+$ |
| SSA (N-(2-sulfo-1,1-dimethylethyl)acrylamide sodium salt) |
| XX = $-CH_3$ |
| YY = $-(CO)-(NH)-C(CH_3)_2CH_2SO_3{-}Na^+$ |
| CEA (N-2-carboxyethylacrylamide) |
| XX = $-H$ |
| YY = $-(CO)-(NH)-CH_2CH_2CO_2H$ |

TABLE 3

Monomer Composition of Barrier Layer Polymers

| Label | Type | Monomers | Monomer Ratio | TRG? | Ratio % |
|---|---|---|---|---|---|
| D | + | (IPA)(APM) | 90:10 | Yes | Mole |
| E | + | (IPA)(APM) | 92:8 | Yes | Mole |
| F | + | (IPA)(A)(APM) | 85:10:5 | Yes | Mole |
| G | + | (TBA)(APM) | 75:25 | Yes | Mole |
| H | + | (TBA)(APM) | 80:20 | Yes | Mole |
| I | + | (TBA)(APM) | 83:17 | Yes | Mole |
| J | + | (TBA)(APM) | 84:16 | Yes | Mole |
| K | + | (NBA)(APM) | 80:20 | Yes | Mole |
| L | + | (TBMA)(APM) | 80:20 | Yes | Mole |
| M | + | (TBA)(IPA)(APM) | 65:20:15 | Yes | Mole |
| N | + | (DOA)(APM) | 80:20 | Yes | Mole |
| O | + | (TBA)(DOA)(APM) | 60:20:20 | Yes | Mole |
| P | + | (IPA)(MBA)(APM) | 80:10:10 | Yes | Mole |
| Q | + | (NBM)(AEM)(HEM) | 50:15:35 | No | Weight |
| Qa | + | (NBM)(AEM)(HEM) | 50:30:20 | No | Weight |
| R | + | (NBM)(AEM)(HEM) | 40:25:35 | No | Weight |
| S | + | (NBM)(AEM)(HEM) | 26:22:52 | No | Weight |
| T | + | (NBM)(AEM)(HEM) | 20:15:65 | No | Weight |
| U | − | (TBA)(A)(SSA) | 75:20:5 | Yes | Mole |
| V | − | (NBM)(SEM)(AAM)(HEM) | 60:5:10:25 | No | Weight |
| Va | − | (NBM)(SEM)(AAM)(HEM) | 70:2.5:10:17.5 | No | Weight |
| Vb | − | (BZM)(SEM)(AAM)(HEM) | 50:2.5:10:37.5 | No | Weight |
| Vc | − | (2EHM)(SEM)(AAM)(HEM) | 50:5:10:35 | No | Weight |
| Vd | − | (NEM)(SEM)(AAM)(HEM) | 50:5:10:35 | No | Weight |
| Ve | − | (BZM)(SEM)(AAM)(HEM) | 60:2.5:10:27.5 | No | Weight |
| W | +/− | (TBA)(CEA)(APM) | 76:8:16 | Yes | Mole |
| X | +/− | (TBA)(A)(IPA)(APM) | 76:8:16 | Yes | Mole |
| Y | +/− | (TBA)(A)(SSA)(APM) | 65:20:5:10 | Yes | Mole |

The barrier polymers can be prepared by synthetic procedures well known in the art. The polymers of this invention may be coated in the conventional manner. The amount of permeability of the barrier layer may be adjusted by adding gelatin or other water soluble polymers to the layer. Such water soluble polymers may comprise up to 50 percent of the barrier layer, but preferably no more than 25 percent. This method of adjusting permeability is particularly useful with polymers containing a high proportion of hydrophobic monomers and can alleviate the need to prepare different polymers of varying desired levels of permeability. The permeability of the layer may also be adjusted by varying the thickness of the polymer or polymer/gelatin layer. It has also been noted that surfactants or surfactant-like compounds, used with the polymer may affect the permeability. The surfactants or surfactant-like compounds, for example 2,5-dihydroxy-4-(1-methylheptadecyl)benzenesulfonic acid-monopotassium salt, are not added directly to the barrier layer but may be utilized in other layers. These surfactant compounds may diffuse and become associated with the polymer layer and affect the hydrophobicity of the polymer layer. All surfactants appear to increase the hydrophobic nature of the subject polymer layers, but surfactants or surfactant-like compounds of opposite charge to the utilized polymer are more effective at reducing permeability. The TRG polymers described above are a particularly preferred class of polymers of this invention. Solutions of such polymers are advantageous for coating because they can either be heat thickened or chill thickened upon application to a film to form layers with sharp and distinct interfaces. The preparation of TRG polymers is more fully described in U.S. application Ser. No. 7/502,726, which is incorporated herein by reference.

Stripping layers are included in preferred embodiments to facilitate the mechanical separation of receiver layers and mordant layers from donor layers and diffusible dye forming layers. Stripping layers are usually coated between a mordant containing layer or dye receiving layer and one or more diffusible dye forming layers. Stripping layers may be formulated essentially with any material that is easily coatable, that will allow processing chemistry and solutions to pass therethrough, that will maintain dimensional inegrity for a sufficient length of time so that a suitable image may be transferred by dye diffusion therethrough with sufficiently adequate density and sharpness, and that will facilitate the separation of donor and receiver components of the photographic element under wet or dry stripping conditions. Said dimensional stability must be maintained during storage and at least partway through the development and dye forming process. In preferred embodiments this dimensional stability is maintained during all wet processing steps and during subsequent drying. Various stripping polymers and stripping agents may be used alone and in combination in order to achieve the desired strippability in particular processes with particular photographic elements. The desired strippability in a given process is that which results in clean separation between the image receiving layer and the emulsion and diffusible dye forming layers adhering to the image receiving layer. Good results have in general been obtained with stripping agents coated at level of 3 mg/m$^2$ to about 500 mg/m$^2$. The particular amount to be employed will vary, of course, depending on the particular stripping agent employed and the particular photographic element used, and the particular process employed.

Perfluorinated stripping agents have been disclosed by Bishop et al. in U.S. Pat. No. 4,459,346, the disclosure of which is incorporated herein in its entirety by reference. In a preferred embodiment of our invention, the stripping layer comprises stripping agents of the following formula:

$$CF_3(CF_2)_n-SO_2-\overset{\overset{R_1}{|}}{N}-CH_2R_2$$

wherein $R_1$ is an alkyl or substituted alkyl group having from 1 to about 6 carbon atoms or an aryl or substituted aryl group having from about 6 to about 10 carbon atoms; $R_2$ is $$-\overset{\overset{O}{\|}}{C}-O-(CH_2CH_2O)_x-R_3,$$

$$-\overset{\overset{O}{\|}}{C}-O-(CH_2)_y-R_3,$$

$$-CH_2-O-(CH_2CH_2O)_z-R_3;$$

$R_3$ is H or $R_1$; n is an integer of from about 4 to about 19; x and y each represents an integer from about 2 to about 50, and z each represents an integer of from I to about 50. In another preferred embodiment, $R_1$ is ethyl, $R_2$ is $$-\overset{\overset{O}{\|}}{C}-O-(CH_2CH_2O)_x-H,$$

n is about 8, and x is about 25 to 50. In another preferred embodiment, R, is ethyl, $R_2$ is $$-\overset{\overset{O}{\|}}{C}-O-(CH_2)_y-H,$$

n is about 8, and y is about 25 to 50. In another preferred embodiment, $R_1$ is ethyl, $R_2$ is $-CH_2O(CH_2CH_2O)_2H$, n is 8 and z is 1 to about 30.

If the process of this invention is used to produce a transparency element for use in high magnification projection, it is desirable to maintain sharpness and to minimize the thickness of the diffusion path. This minimization is achieved in part by using a stripping layer that does not swell appreciably and which is as thin as possible. These requirements are met by the perfluoronated stripping agents herein described. These agents provide clean stripping and do not materially alter the surface properties at the stripping interface. These perfluoronated stripping agents also provide for a stripping layer with weak dry adhesion. A strong dry adhesion makes separation of substantially dry elements difficult.

Preferred stripping agents useful in the process of this invention include the compounds listed in Table 4.

TABLE 4

| Stripping Agents |
|---|
| $C_8F_{17}SO_2-\overset{\overset{CH_2CH_3}{\|}}{N}-CH_2-\overset{\overset{O}{\|}}{C}-O-(CH_2CH_2O)_{40}-H$ |
| SA1 |
| (Fluorad ® FC-431 [3M Company]) |
| $C_8F_{17}SO_2-\overset{\overset{CH_2CH_3}{\|}}{N}-CH_2-\overset{\overset{O}{\|}}{C}-O-(CH_2)_{40}-H$ |
| SA2 |
| (Fluorad ® FC-432 [3M Company]) |
| $C_8F_{17}SO_2-\overset{\overset{CH_2CH_3}{\|}}{N}-(CH_2CH_2O)_{\overline{2-30}}H$ |
| SA3 |
| (Fluorad ® FC-170 [3M Company]) |

Wet stripping is facilitated by stripping polymers that are soluble in processing solution, or become soft in such a solution. Preferred polymers for wet stripping include gum arabic, sodium alginate, pectin, cellulose acetate hydrogen phthalate, polyvinyl alcohol, hydroxyethyl cellulose, agarose, polymethacrylic acid, plasticized methyl cellulose, ethyl cellulose, methyl methacrylate, butyl methacrylate, and polyethylene oxide. The disclosures of Land (in U.S. Pat. No. 3,220,835) and of Dannhauser (in U.S. Pat. No. 3,730,718) are incorporated herein in their entirety by reference. Also preferred are stripping layers formulated with polyaddition products of bisacrylamides and diamines, as disclosed by Tsuji et al.(in U.S. Pat. No. 3,820,999), the disclosure of which is incorporated herein by reference. Other preferred wet stripping polymers are listed in Table 5.

TABLE 5

| Stripping Polymers |
|---|
| $-(CH_2\underset{\underset{N(CH_3)_2}{\|}}{\overset{\overset{O}{\|}}{C}}H)_x-(CH_2\underset{\underset{O(CH_2)_3CH_3}{\|}}{\overset{\overset{O}{\|}}{C}}\overset{\overset{CH_3}{\|}}{H})_y-(CH_2\underset{\underset{OCH_2CH_2O-\underset{\underset{CH_3}{\|}}{(CCH_2)}-\overset{\overset{O}{\|}}{C}}{\|}}{\overset{\overset{O}{\|}}{C}}\overset{\overset{CH_3}{\|}}{H})_z-$ |
| SP1 |
| (where x = 30–70; y = 20–60; z = 0–20 mol percent) |

TABLE 5-continued

| Stripping Polymers |
|---|
| $-(CH_2CH)_x-(CH_2CH)_y-$<br>$C{=}O$ $C{=}O$<br>$OCH_3$ $(OCH_2CH_2)_n-C_{13}H_{27}$-sec<br>SP2<br>(where x = 20–80; y = 20–80 mol percent) |

Mordant layers are formulated as combinations of hydrophilic colloidal binder and mordant polymer. The hydrophilic colloidal binder is preferably gelatin. Other preferred binders include gelatin derivatives, polyvinyl alcohol, cellulose derivatives, polysaccharides such as starches and gum arabic, synthetic substances such as water soluble polyvinyl compounds, synthetic substances such as dextrin, pululan, polyvinyl pyrrolidone and acrylamides. It is known to incorporate UV stabilizers in such dye fixing layers. It is also known to separate such layers into two sublayers, where one of said sublayers comprises mordant polymer and the other of said sublayers comprises a UV stabilizer.

Mordant polymers that contain a vinyl monomer unit having a tertiary amino group or a quaternary ammonium group are preferred. Such preferred mordant polymers have been described by Aono et al. in U.S. Pat. No. 4,636,455 and are incorporated herein by reference. Said mordant polymers comprise vinyl monomer units selected from the group consisting of:

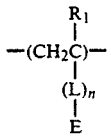

mo-i wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; and n is 0 or 1;

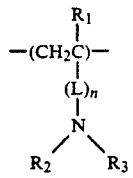

mo-ii wherein $R_1$, L, and n have the same meaning as in formula mo-i; $R_2$ and $R_3$ are the same or different and each represents an alkyl group having I to 12 carbon atoms or an aralkyl group having 7 to 20 carbon atoms, and $R_2$ and $R_3$ may form, together with the adjacent nitrogen atom, a cyclic structure;

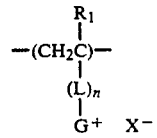

mo-iii wherein $R_1$, L, and n have the same meaning as in formula mo-i; $G^+$ represents a hetero ring which is quarternized and contains a carbon-nitrogen double bond; and $X^-$ represents a monovalent anion; and

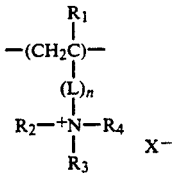

mo-iv wherein $R_1$, L, and n have the same meaning as in formula mo-i; $R_2$ and $R_3$ have the same meaning as in formula mo-ii; $R_4$ has the same definition as $R_2$ and $R_3$; $X^-$ has the same meaning as in formula mo-iii, and $R_2$ and $R_3$, $R_3$ and $R_4$, or $R_2$ and $R_4$ may form, together with the adjacent nitrogen atom, a cyclic structure.

Mordant polymers as described by Klein et al., in U.S. Pat. No. 4,450,224, incorporated herein in its entirety by reference, and comprising vinyl imidazolium, vinyl imidazole, acrylonitrile, methacrylonitrile, and $\alpha,\beta$-ethylenically unsaturated monomers are preferred.

Copolymers of imidazole containing monomers and sulfinic acid containing monomers are preferred mordant polymers. Such mordant polymers have been described by Nakamura et al. in U.S. Pat. No. 4,594,308, the disclosure of which is incorporated herein by reference. Other preferred mordant polymers comprising imidazole containing repeat units have been disclosed by Shibata and Hirano in U.S. Pat. No. 4,774,162, the disclosure of which is incorporated herein in its entirety. Preferred mordant polymers are depicted in Table 6, wherein the repeating-unit subscripts indicate weight percents of the repective repeating units and wherein the chloride anion may be replaced with any monovalent anion.

TABLE 6

| Mordant Polymers | |
|---|---|
| 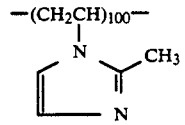 | MO1 |
| 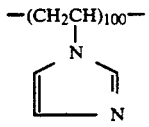 | MO2 |
| 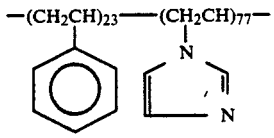 | MO3 |
| 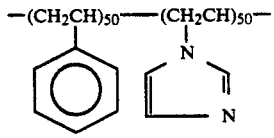 | MO4 |
| 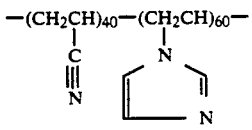 | MO5 |

TABLE 6-continued
Mordant Polymers
MO6
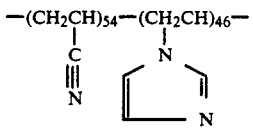
MO7
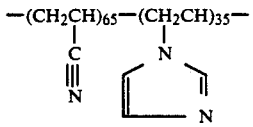
MO8
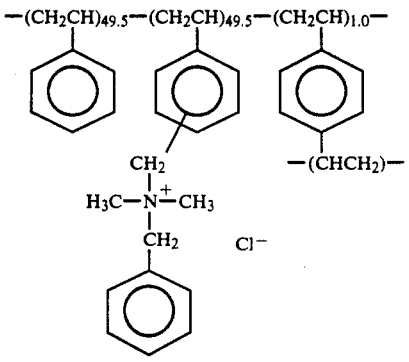
MO9
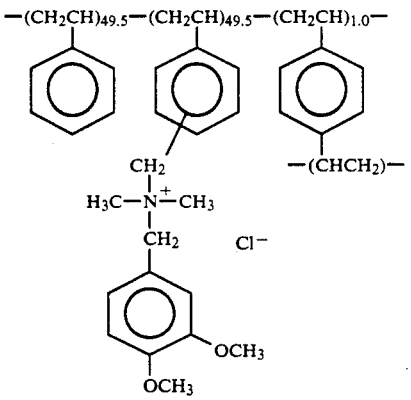
MO10
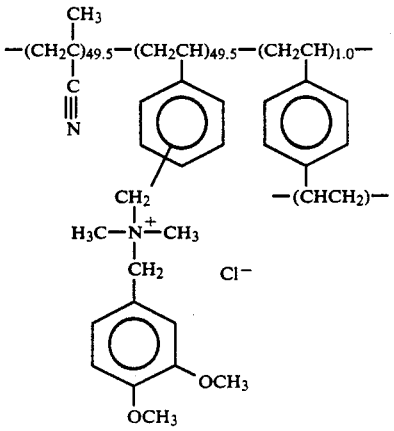
TABLE 6-continued
Mordant Polymers
MO11
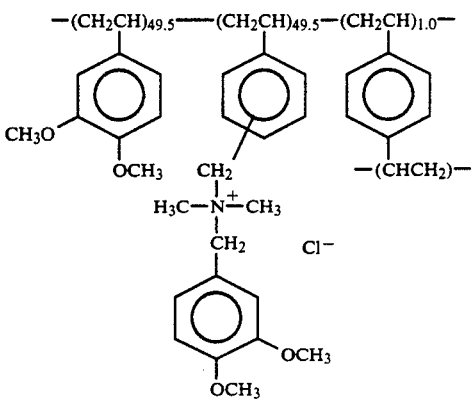
MO12
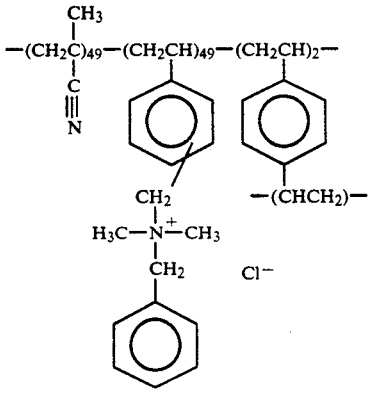
MO13
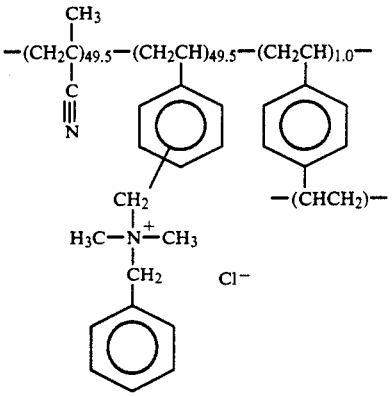
MO14
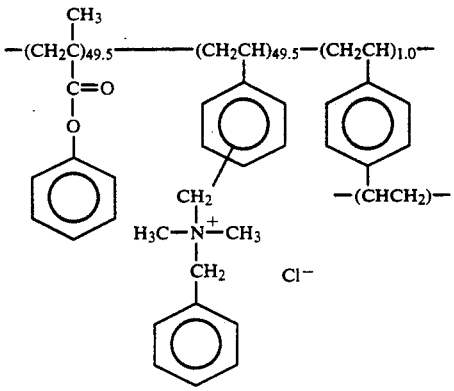

TABLE 6-continued
Mordant Polymers
MO15
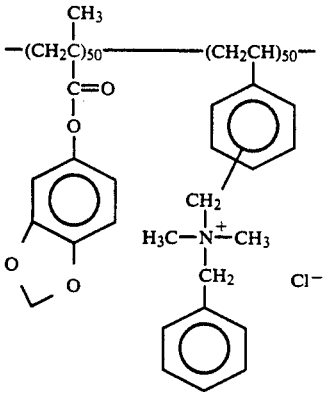
MO16
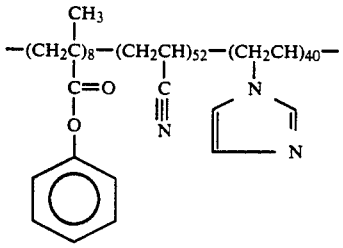
MO17
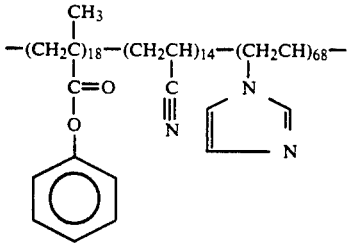
MO18
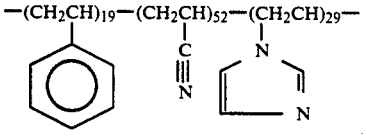
MO19
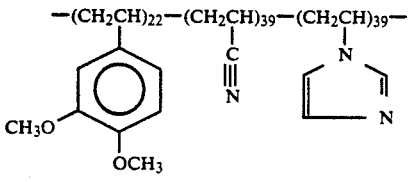
MO20
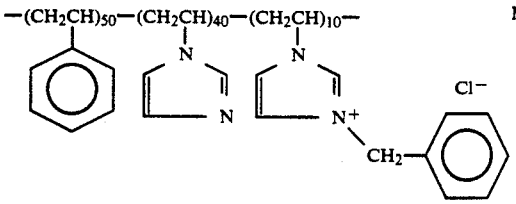
TABLE 6-continued
Mordant Polymers
MO21
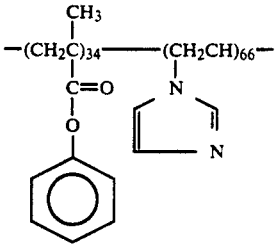
MO22
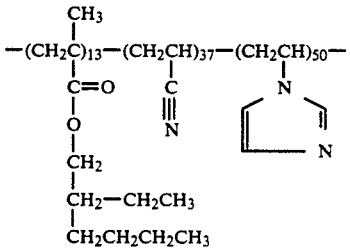
MO23
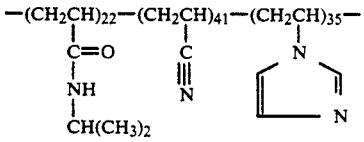
MO24
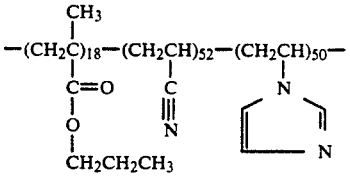
MO25
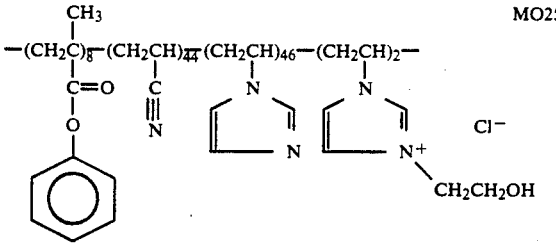
MO26
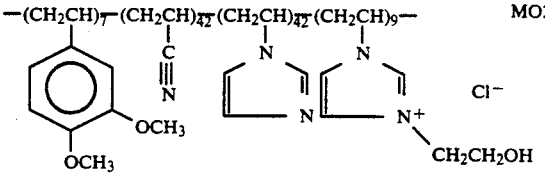
MO27
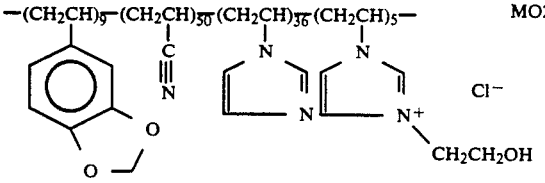

TABLE 6-continued

Mordant Polymers

MO28

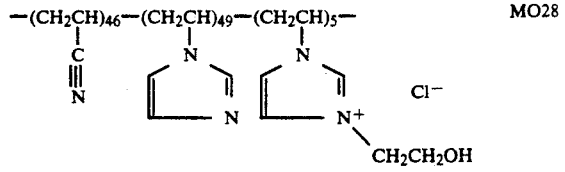

MO29

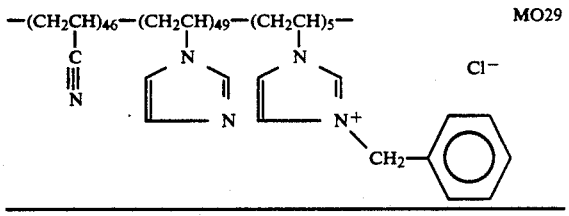

The mixture of colloidal binder (preferably gelatin) and mordant polymer and the amount coated in the formulation of the mordant layer may easily be determined by those skilled in the art and will vary according to the particulars of the element and use, such as the particular polymeric mordant used and the particular development process used. The ratio of mordant polymer to binder is preferably in the range of 1:5 to 5:1 (weight ratio), and the amount of mordant polymer coated is preferably in the range of 0.2–15 g/m$^2$, more preferably in the range of 0.5–8 g/m$^2$. The molecular weight of the polymer mordant used is preferably in the range of 1,000–1,000,000, and more preferably in the range of about 10,000–200,000.

In the following discussion of suitable materials for use in the emulsions, elements, and methods according to the invention, reference will be made to *Research Disclosure,* December 1989, Item 308119, published by Kenneth Mason Publications, Ltd., Emsworth, Hampshire PO107DQ, U.K. This publication will be identified hereafter as "*Research Disclosure.*

The silver halide emulsion employed in the elements of this invention can be either negative working or positive working. Examples of suitable emulsions and their preparation are described in *Research Disclosure,* Sections I and II and the publication cited therein. Examples of suitable vehicles for the emulsion layers and other layers of elements of this invention are described in,,*Research Disclosure,* Section IX and the publications cited therein.

The photographic elements of this invention or individual layers thereof can contain, for example, brighteners (see *Research Disclosure,* Section V), antifoggants and stabilizers (see *Research Disclosure,* Section VI), antistain agents and image dye stabilizers (see *Research Disclosure,* Section VII, paragraphs I and J), light absorbing and scattering materials (see *Research Disclosure,* Section VIII), hardeners (see *Research Disclosure,* Section IX), plasticizers and lubricants (see *Research Disclosure,* Section XII) antistatic agents (see *Research Disclosure,* Section XIII), matting agents (see *Research Disclosure,* Section XVI), and development modifiers (see *Research Disclosure,* Section XXI).

The photographic elements can be coated on a variety of supports such as described in *Research Disclosure,* Section XVII and the references described therein.

Photographic elements can be exposed to actinic radiation, typically in the visible region of the spectrum, to form a latent image as described in *Research Disclosure,* Section XVIII and then processed to form a visible dye image as described in *Research Disclosure,* Section XDC. Processing to form a visible dye image includes the step of contacting the element with a color developing agent to reduce developable silver halide and oxidizing the color developing agent. Oxidized color developing agent in turn reacts with the coupler to yield a diffusible dye.

Said contacting of the element with a color developing agent comprises wetting at least the emulsion side of said element with a volume of processing solution that exceeds the swelling volume of the element. The requisite processing solution volume to element area ratio will preferably exceed 20 mL/m$^2$. This ratio will more preferably exceed 200 mL/m$^2$.

With negative working silver halide, the processing step described above gives a negative image. To obtain a positive (or reversal) image, this step can be preceded by development with a nonchromogenic developing agent to develop exposed silver halide, but not form dye, and then uniformly fogging the element to render unexposed silver halide developable. Alternatively, a direct positive emulsion can be employed to obtain a positive image.

After image formation the element is subjected to a stop and wash bath that may be the same or different. Thereafter, the element is dried. The donor and receiver components of the element are then stripped apart, preferably when the element is nominally dry, although these components may be separated while the element is still wet. Means for wet stripping are described for example by Hanselman and Schreiber in U.S. Pat. No. 4,359,518, the disclosure of which is incorporated herein in its entirety by reference. Preferred means for dry stripping are described by Texter et al. in U.S. Ser. No. 7/805,717 filed Dec. 6, 1991, and the disclosure of said application is incorporated herein in its entirety by reference. Further preferred means for stripping are described by Lynch and Texter in U.S. Ser. No. 07/858,726 filed Mar. 27, 1992; this application is also incorporated herein in its entirety by reference for all that it discloses.

The advantages of the present invention will become more apparent by reading the following examples. The scope of the present invention is by no means limited by these examples, however.

Examples

Preparation of Barrier Polymer

VMX

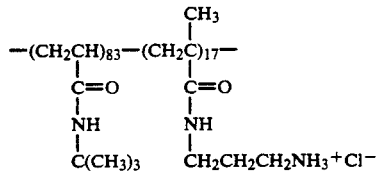

To a three-liter 3-necked flask, fitted with a stirrer and condenser, was added about 450 g of methanol and about 350 g of distilled water. The solution was degassed for about 30 minutes with nitrogen. About 105.4 g of t-butyl acrylamide (TBA), about 30.3 g of N-(3-aminopropyl) methacrylamide hydrochloride (APM), and about 0.35 g of AIBN (2,2'-azobisisobutylnitrile) were then added and the solution was stiffed at about 60° C. under nitrogen for about 16 hours. A clear, viscous solution was obtained. The condenser was removed and about 1 kg of distilled water was added. The solution was stiffed at 80° C. with a strong nitrogen sweep for 16 hours to remove the methanol. The solution was cooled to give a gel containing about 9.7% solids with an IV of 0.86 in 0. 1M LiCl. This copolymer polymer of TBA and APM at mole ratio 83:17 (polymer 1 in Table 3) is designated "VMX" for reference purposes in the following.

Preparation of Stripping Layer Polymer

SP3

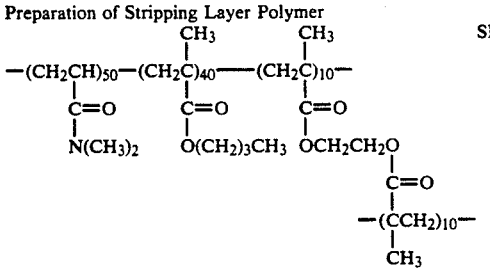

To a one-liter addition header was added about 800 mL of distilled water, about 100 g of N,N-dimethylacrylamide, about 80 g of n-butylmethacrylate, and about 20 g of ethylene glycol dimethacrylate. The suspension was bubled with nitrogen for about 10 minutes and then about 20 mL of a 30% aqueous solution (by weight) of Sipex SB (Alcolac Corp.) were added. To a two-liter 3-necked flask were added about 800 mL of distilled water. This flask was placed in an 80° C. bath, stirred, and bubbled with nitrogen for 10 minutes. About 20 nit of 30% aqueous Sipex SB were added, and then about 2.0 g of potassium persulfate and about 0.6 g of sodium metabisulfite were added. Immediately thereafter the contents of the addition header were added over a 50 minute period. The resulting bluish-white latex was stirred at 80° C. under nitrogen for an additional hour. The latex was then cooled and dialyzed against distilled water for 16 hours to give a viscous suspension containing about 8.6% solids of the desired polymer SP3.

Preparation of Mordant Polymer M08

To a 190 L glass lined reactor equipped with variable speed agitator (reactor 1), automatic temperature control, vacuum, and nitrogen service was added about 104 kg of water with agitation. About 19.6 kg of water was added to a similarly equipped reactor (reactor 2). The space above the water, in each reactor, was evacuated and returned to atmospheric pressure under nitrogen three times. Thereafter nitrogen flow through the reactors was maintained. About 1. 1 kg of aqueous Triton® 770 (a 30% by weight aqueous solution) was added to reactor 1, and the temperature control for reactor 1 was set to 64° C. To the other reactor (2) was added about 1.1 kg of Triton 770 (30% by weight) and about 304.6 g (1.30 mol) of 55% (w/w) 1,4-divinylbenzene. About 8.4 kg of styrene and about 12.2 kg of vinylbenzyl chloride were added to reactor 2 under vacuum, and pressure was returned to atmospheric with nitrogen. The temperature of reactor 2 was then set at 64° C. and the emulsion was maintained with agitation. About 19.7 g of sodium metabisulfite and about 162.8 g of potassium persulfate were then added to reactor 1. Within about two minutes, transfer of the emulsion in reactor 2 into reactor I was commenced at a rate of 330 ml/min. This transfer was continued for about 120 min.

About 9.9 g of sodium metabisulfite was dissolved in about 900 g of water. Another solution comprising about 16.4 g of potassium persulfate and about 900 g water was prepared. Fifteen minutes after completion of the emulsion charge addition to reactor 1, these two solutions were added to reactor 1. The reaction in reactor 1 was continued with stirring at 64° C. for an additional 3 hours, and then the temperature control was decreased to 20° C. When the reaction misture temperature dropped to less than 30° C., the latex was filtered through a 50 μm bag filter into a clean 208 L drum. About 147 kg of aquous latex at about 14.15% (w/w) solids was obtianed. Reactor I was then flushed with water, and the latex suspension was reintroduced into the reactor. Temperature control was set to 25° C. About 11.29 kg of N,N-dimethyl benzylamine was preweighed for subsequent addition. When the temperature of the reaction mixture reached 25° C., intoduction of the N,N-dimethyl benzylamine into reactor 1 was started at a rate of 50 mL/min. When this addition, lasting about an hour, was complete, the temperature controller for reactor 1 was set to 60° C. Agitation is adjusted throughout to maintain stirring while minimizing foaming. When the reaction mixture reached 60° C., the nitrogen feed was stopped, the reactor vent was closed, and stirring was maintained for about 18 hours. After this time the temperature was lowered to 20° C. and the nitrogen flow was resumed. After cooling the product was filtered through a 30 μm filter bag and about 183 kg of the desired latex suspenson of M08 was obtained.

Preparation of Coupler Dispersions

Dispersions of couplers Y1 (351CIS), Y2(35IXT), Y3(381HEI), C (114AHZ), and M (241CG); see Table 7) were prepared by colloid milling methods well known in the art. About 2.7 g of coupler Y1 was dissolved in about 8.1 g of cyclohexanone. About 3.6 g of a 10% (w/w) Alkanol-XC aqueous solution, about 28.8 g of 12.5% (w/w) aqeuous gelatin, and about 46.8 g of water were combined at 50° C. About 2.7 g of coupler Y2 was dissolved in about 8.1 g of ethylacetate. About 3.6 g of a 10% (w/w) Alkanol-XC aqueous solution, about 28.8 g of 12.5% (w/w) aqeuous gelatin, and about 46.8 g of water were combined at 500C. About 2.7 g of coupler Y3 was dissolved in about 8.1 g of cyclohexanone.. About 3.6 g of a 10% (w/w) Alkanol-XC aqueous solution, about 28.8 g of 12.5% (w/w) aqeuous gelatin, and about 46.8 g of water were combined at 50° C. About 2.7 g of coupler C was dissolved in about 8.1 g of ethylacetate. About 3.6 g of a 10% (w/w) Alkanol-XC aqueous solution, about 28.8 g of 12.5% (w/w) aqeuous gelatin, and about 46.8 g of water were combined at 50° C. These aqeuous and ethylacetate solutions were then combined and briefly mechanically stirred. The resulting mixtures were then passed through a Gaulin colloid mill five times and chill set. The dispersions of C, Y1, Y2, and Y3 were noodled and washed to remove the ethyl acetate. About 7.8 g of coupler M was dissolved in about 15.6 g of cyclohexanone. About 10.4 g of a 10% (w/w) Alkanol-XC (Du Pont) aqueous solution, about 83.2 g of 12.5% (w.w) aqeuous gelatin, and about 143 g of water were combined at 500° C. These aqeuous and cyclohexanone solutions were then combined and briefly mechanically stirred. The resulting mixture was then passed through a Gaulin colloid mill five times, and the resulting dispersion was noodled and washed to remove the cyclohexanone. After washing, these dispersions were remelted and chill set, and stored in the cold until used for coating.

Preparation of Coating Base

A titania-pigmented reflection base was overcoated with a gelatin-mordant polymer mixture. A slurry comprising about 259.5 g of a 17% by weight aqueous suspension of the mordant polymer M08, about 46.4 g of 95% by weight type V, Class HX/001 doubly deionized gelatin (Rouselleaux), and about 931.5 g distilled water was prepared at 50° C. and chill set. This chill set slurry was then noodled and washed for several hours. The washed noodles were combined, remelted, and chill set again to yield about 840 g of slurry about 4.2% (by weight) in gelatin and M08. Titania pigmented paper reflection base was subjected to a corona discharge treatment, and thereafter overcoated with a melt comprising equal weights of gelatin and M08. This melt was prepared by combining at 50° C. about 842 g of the aforesaid gelatin/MO8 slurry, about 10.2 g of spreading surfactant (10% by weight Olin-10G), and about 158.6 g of distilled water. This melt was coated on the reflection base at a coverage of about 91.3 mL/m$^2$ to yield a mordant covered base with coverages of about 3.22 g/m$^2$ in both gelatin and M08. This base material was dried and stored until used in coating the multilayer test elements.

Coating of Photographic Elements

Test photographic elements were coated as described in the layer format of Table 8. The base with coated mordant layer (MO8 and gel) described above was first overcoated with a stripping layer. This layer was coated by preparing a solution comprising about 22.67 g of a 6.8% (by weight) aqueous suspension of SP3, about 1.85 g of a 50% (by weight) solution of SA1 in ethyl acetate, about 2.3 g of 10% (by weight) aqueous Olin 10G, about 6.94 g of 6.7% (by weight) aqueous TX-200, and

TABLE 7

Coupler Structures

M

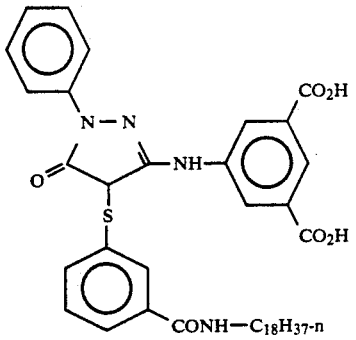

Y1

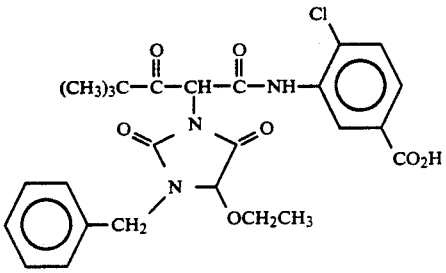

TABLE 7-continued

Coupler Structures

Y2

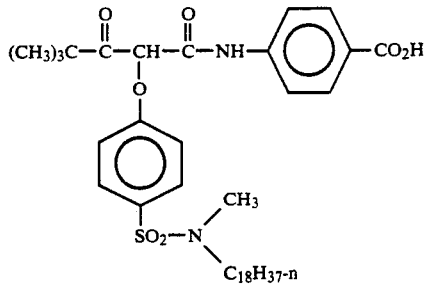

Y3

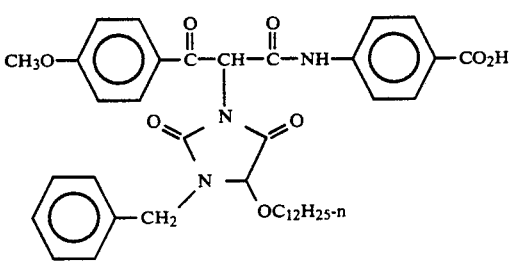

C

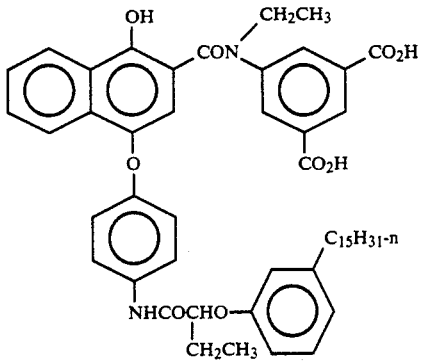

TABLE 8

| |
|---|
| VMX (966 mg/m$^2$) |
| gel (Type IV; 107 mg/m$^2$) |
| Coupler (430–640 mg/m$^2$) |
| Blue Sensitized AgCl (430 mg Ag/m$^2$ as AgCl) |
| gel (Type IV; 1.61 g/m$^2$) |
| SA1 (32 mg/m$^2$) |
| SP3 (54 mg/m$^2$) |
| MO8 (3.22 g/m$^2$) |
| gel (Type V; 3.22 g/m$^2$) |
| Reflection Base |

about 891 g of distilled water. This solution was coated over the mordant layer at a coverage of about 32 mL/m$^2$ to yield coverages of about 32 mg/m$^2$ for SA1 and about 54 mg/m$^2$ for SP3. In separate coatings, coupler Y1 was coated (Example 1) at a level of 439 mg/m$^2$, coupler Y2 was coated (Example 2) at a level of 580 mg/m$^2$, coupler Y3 was coated (Example 3) at a level of 567 mg/m$^2$, coupler C was coated (Example 4) at a level of 623 mg/m$^2$, and coupler M was coated (Example 5) at a level of 537 mg/m$^2$. Melts for the coupler containing layers were prepared by combining a blue sensitized silver chloride emulsion, an appropriate amount of coupler dispersion, aqueous gelatin, spreading surfactant, and distilled water. These melts were coated at 50° C. A melt for coating the barrier layer was prepared by combining at 50° C. about 198 g of a 5% (by weight) aqueous solution of VMX, about 8.8 g of 12.5% (by weight) aqueous gelatin, about 7.9 g of 10% (by weight) aqueous Olin 10G, about 0.30 g of Zonyl FSN, about 50.42 g of a 1.8% (by weight) of aqueous 1,1'-[methylene bis(sulfonyl)]bis-ethene, and about 285 g of distilled water. This melt was used to overcoat the coupler/mordant/base coatings at a coverage of about 54 mL/m$^2$ to yield coverages of about 966 mg/m$^2$ for VMX and about 107 mg/m$^2$ for gelatin. An additional coating (Example 6) of coupler M, identical to that of Example 5 except that the coverage of SA1 was 64 mg/m$^2$, was made.

Processing and Sensitometry

These test coatings were exposed for 0.01 s to a tungsten light source (285020 K.) through a 0–3 density 21-step tablet and processed at 95° F. The process comprised development for 45 sec in a large volume of developer solution. The developer solution was prepared according to the following composition

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH = 10.04 @ 27° C. | |

Control strips were then immersed in a bleach-fix bath for 45 sec to remove silver and silver halide. This bleach-fix solution was prepared according to the following composition:

| | |
|---|---|
| Aqueous ammonium thiosulfate (56.5% w/w) and ammonium sulfite (4% w/w) | 127.4 g |
| Sodium metabisulfite | 10 g |
| Glacial acetic acid | 10.2 g |
| Ammonium ferric EDTA (1.56 M with 10% molar excess of EDTA) | 110.4 g |
| Water to make one liter | |
| pH = 5.5 @ 26.7° C. | |

These control strips were then washed for 90 sec in water and dried. Comparison strips were placed in a pH 4 buffer stop solution for 60 sec after development, washed in water for 90 sec, and then dried. The test coatings, each approximately 35 mm×305 mm in dimension, were immersed in large volume processing tanks in each of the development, stop, bleach-fix, and wash steps. Each of these solutions comprised a volume of approximately 9 L.

Figure 6:
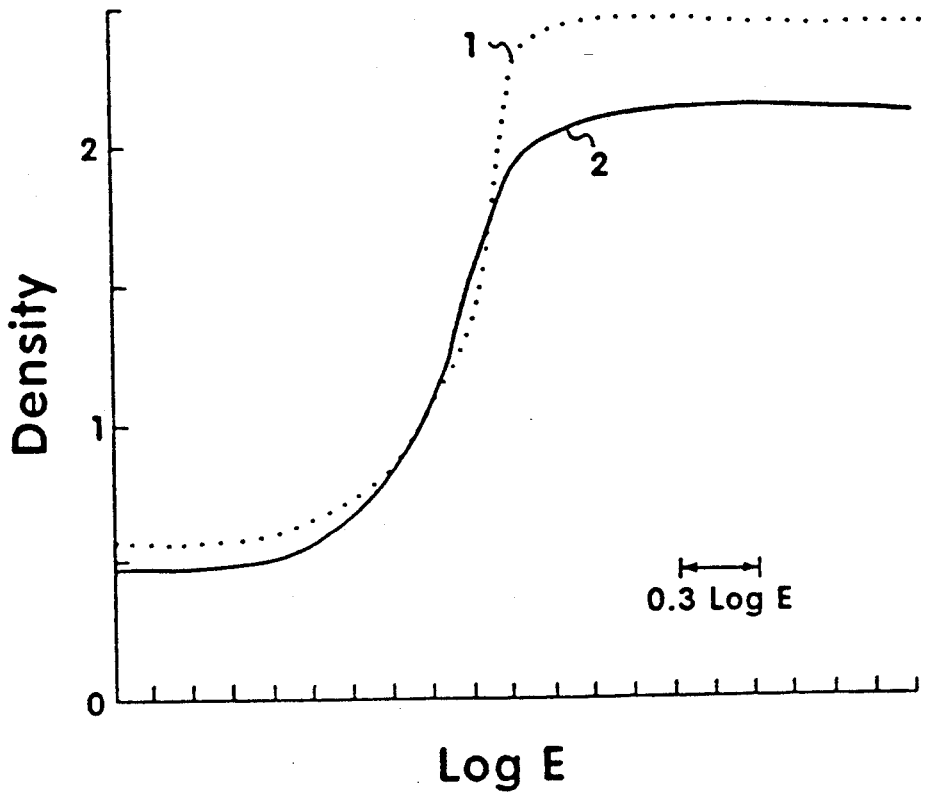
FIG. 6. Sensitometry (status A densitometry) obtained for coating of coupler M (241CG) processed as described in Example 6; curve 1—bleached and fixed integral element; curve 2—receiver element.

After drying the overcoat and emulsion layers (donor element) were removed (stripped) in the comparison strips from the mordant/base layers (receiver element) using the method described by Texter et al. in U.S. application Ser. No. 7/805,717. The emulsion side of the dried and processed test coatings was contacted with the gel subbed (107 mg/m$^2$) side of an ESTAR adhesive element and passed at a rate of about 5 mm/s through pinch rollers heated to a surface temperature of 110° C. and held together under a pressure of 20 psi. The receiver elements were then pulled apart from the ESTAR adhesive element, and the donor layers were thereby stripped at the stripping layer and remained attached to the adhesive element. The barrier layer served to reflect diffusible dye and to minimize dye washout while said (integral) donor and receiver elements were immersed in large volume devleoping, stop, and wash baths. The dye reflection property of the barrier layer was illustrated in copending U.S. application Ser. No. 952,447 of Texter et al., entitled Barrier Layers for Dye Containment in Photographic Elements. The donor layers contained undeveloped AgCl, the silver image, unreacted coupler, and a small fraction of the image dye formed. The receiver elements, on the other hand, retained the majority of image dye formed during color development. Reflection dye densities were then recorded using status-A filters for the control strips, wherein the silver and silver halide were removed by a conventional bleach-fix solution, and the integral element was not separated into donor and receiver components. Reflection dye densities of the stripped receiver elements were similarly recorded for the comparison strips, wherein a stop bath, rather than a bleach-fix bath, was used after developemnt. The corresponding sensitometry is illustrated in FIGS. 1–5 for couplers Y1 (Example 1), Y2 (Example 2), Y3 (Example 3), C (Example 4), and M (Example 5), respectively, where curves 1 correspond to the bleached-fixed control strips (integral element before stripping) and where curves 2 correspond to the stripped receiver elements. The corresponding sensitometry for Example 6 of coupler M, with the higher level of SA1, is illustrated in FIG. 6. It is apparent that dye was transferred to the mordant layer in a very efficient manner in all of these examples, and that efficient color diffusion transfer can be obtained by the process of the present invention with large volume development.

This invention has been described in detail with particular reference to preferred embodiments thereof, but it will be understood that variations and modifications can be effected within the spirit and scope of the invention.

What is claimed is:

1. A diffusion transfer process for forming a color photographic image comprising the steps of:

(a) using an integral element comprising one and only one dimensionally stable layer comprising a coating support, and coated thereon in reactive association a mordant layer comprising a material which binds a diffusible dye, an imaging layer comprising radiation sensitive silver halide, a diffusible dye forming layer comprising a diffusible dye forming compound, a barrier layer overlaying said diffusible dye forming layer, and a stripping layer coated intermediate said mordant layer and a diffusible dye forming layer, wherein said support is selected from the group consisting of reflection base and transparent materials, wherein said diffusible dye forming layer is the same or different than said imaging layer, wherein said barrier layer comprises a polymer that allows the passage of solutions for processing said element when said element is contacted with an external processing bath, and wherein said barrier layer impedes the diffusion out of said element of the diffusible dye formed from said diffusible dye forming compound;

(b) exposing said element to actinic radiation (c) processing said element by contacting said element to an external bath containing compounds selected from the group consisting of color developer compounds of the primary an-fine type, compounds which activate the release of incorporated color developers, and compounds which activate development by incorporated dye developers;

(d) washing said element to remove compounds imbibed in step (c).

2. A process as described in claim 1, wherein said barrier layer is the most distal layer with respect to said support.

3. A process as described in claim 1, wherein said integral element further comprises a layer coated on the side of the support opposite the imaging layer.

4. A process as described in claim 1, wherein said mordant layer comprises an ultraviolet filter dye.

5. A process as described in claim 1, wherein said external bath comprises a volume greater than 20 mL per square meter of element contacting said bath.

6. A process as described in claim 5, wherein said external bath comprises a volume greater than 200 mL per square meter of element contacting said bath.

7. A process as described in claim 1, wherein the diffusible dye forming compound is a molecule selected from the group consisting of

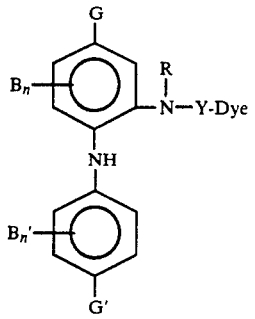

wherein:

$B_n$ and $B'_n$ each represent a photographically inert organic ballasting radicals of such molecular size and configuration as to render said molecule non-diffusible during development in alkaline color developing solution;

G and G' each is hydrogen, hydroxy, —OR', or —$NR_1R_2$ radical wherein R' is a hydrolyzable moiety and $R_1$ and $R_2$ are each hydrogen or an alkyl group provided at least one of G and G' is hydroxy or amino;

R is hydrogen, alkyl, or substituted alkyl;

Y is a divalent linking radical linking selected from the group consisting of an azo radical, a mercuri radical, an oxy radical, an alkylidene radical, a thio radical, a dithio radical, and an azoxy radical;

Dye is a dye radical or dye precursor.

8. A process as described in claim 1, further comprising the step of separating said mordant and support from said diffusible dye forming layer.

9. A process as described in claim 8, further comprising the step of drying said element intermediate said washing and separating steps.

10. A process as described in claim 9, further comprising the step of heating said element prior to and during the separating step.

11. A process as described in claim 1, wherein said mordant layer comprises mordant polymer.

12. A process as described in claim 11, wherein said mordant polymer comprises vinyl monomer units having tertiary amino groups or quaternary ammonium groups and wherein said vinyl monomer units are selected from the group consisting of:

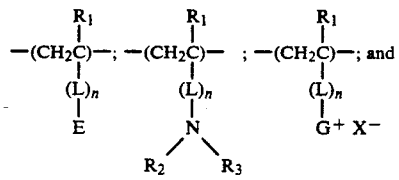

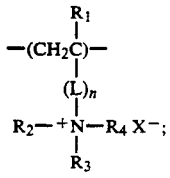

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; n is 0 or 1; $R_2$, $R_3$, and $R_4$ are the same or different and each represents an alkyl group having 1 to 12 carbon atoms or an aralkyl group having 7 to 20 carbon atoms; $G^+$ represents a hetero ring which is quarternized and contains a carbon-nitrogen double bond; $X^-$ represents a monovalent anion; and $R_2$ and $R_3$, $R_3$ and $R_4$, or $R_2$ and $R_4$ may form, together with the adjacent nitrogen atom, a cyclic structure.

13. A process as described in claim 12, wherein said mordant polymer is selected from the group consisting of:

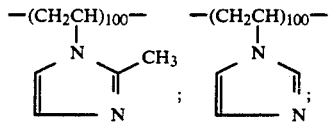

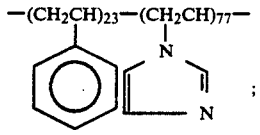

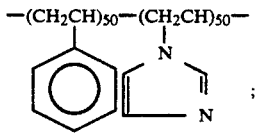

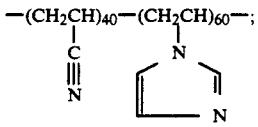

-continued
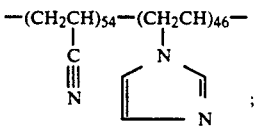
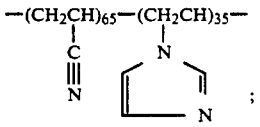
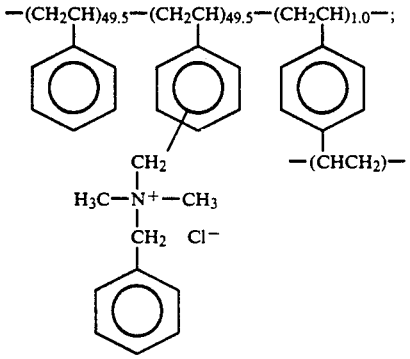
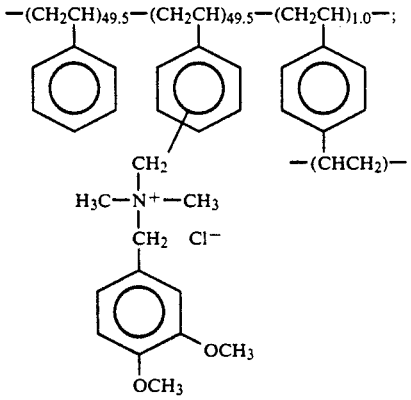
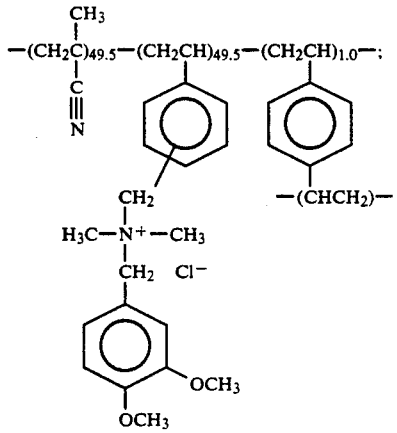
-continued
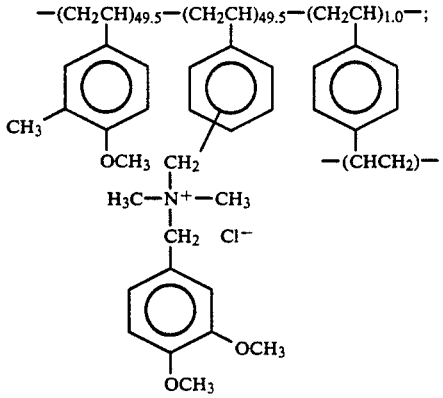
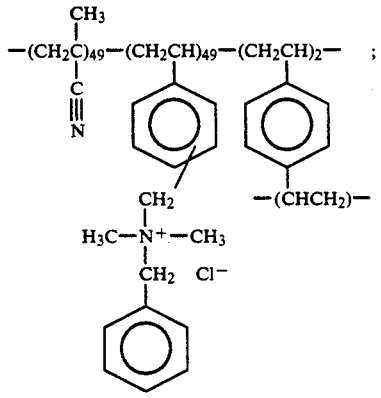
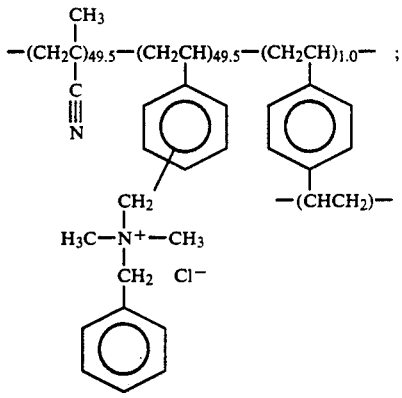
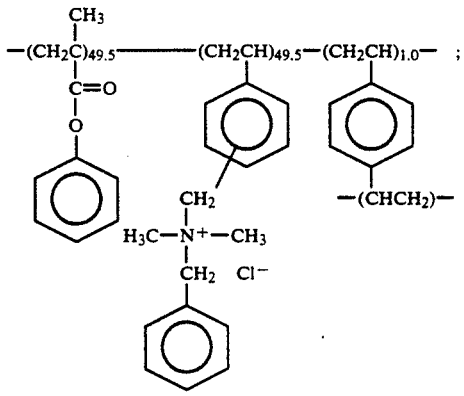

-continued
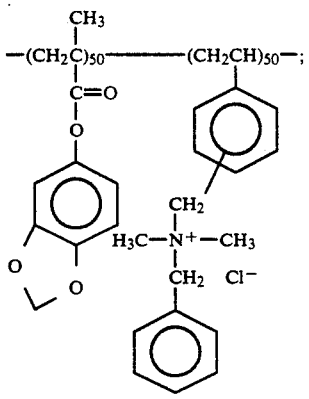
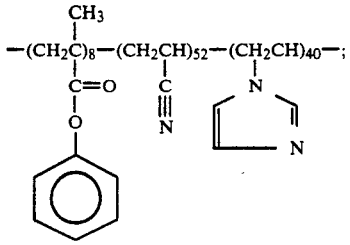
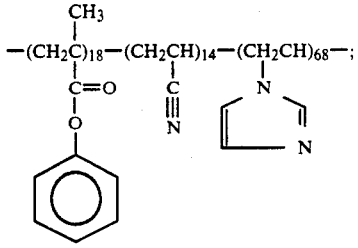
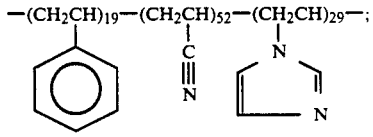
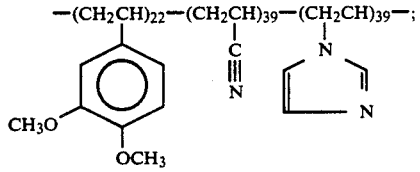
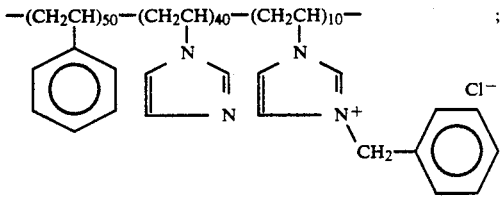
-continued
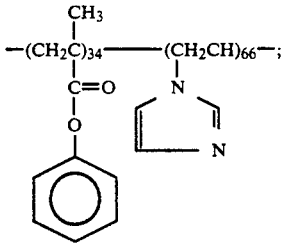
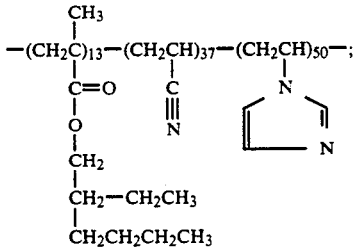
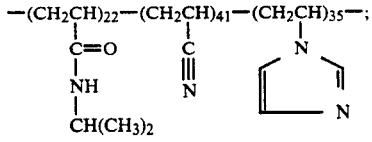
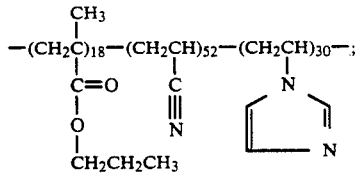
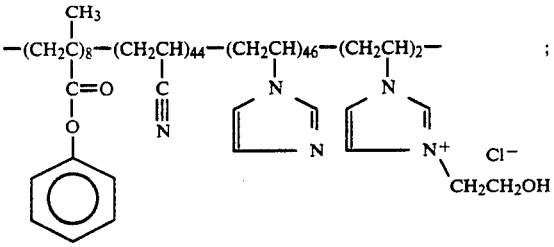
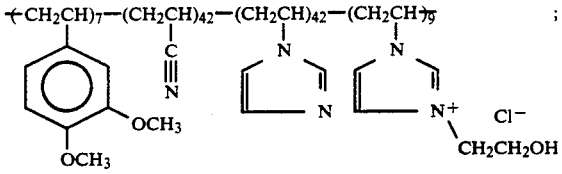
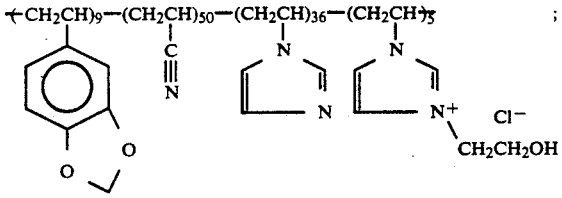
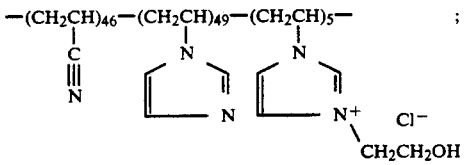

-continued

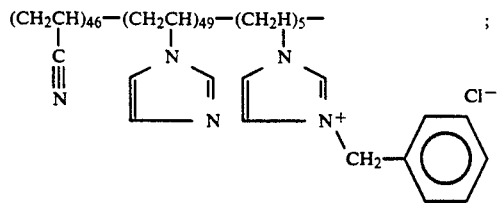

;

and wherein repeating-unit subscripts indicate weight percents of the respective repeating units and the chloride counter ion may be replaced with any monovalent anion.

14. A process as described in claim 1, wherein said mordant layer comprises mordant polymer at a coverage of 0.2–15 g/m$^2$.

15. A process as described in claim 14, wherein said mordant layer comprises mordant polymer at a coverage of 0.5–8 g/m$^2$.

16. A process as described in claim 1, wherein said mordant layer comprises mordant polymer with molecular weight in the range of 1,000–1,000,000.

17. A process as described in claim 16, wherein said mordant layer comprises mordant polymer with molecular weight in the range of 10,000–200,000.

18. A process as described in claim 11, wherein said mordant layer comprises hydrophilic binder.

19. A process as described in claim 18, wherein said hydrophilic binder is gelatin.

20. A process as described in claim 18, wherein said mordant layer comprises a weight-ratio of mordant polymer to hydrophilic binder in the range of 1:5 to 5:1.

21. A process as described in claim 7, wherein said stripping layer comprises stripping polymer selected from the group consisting of:

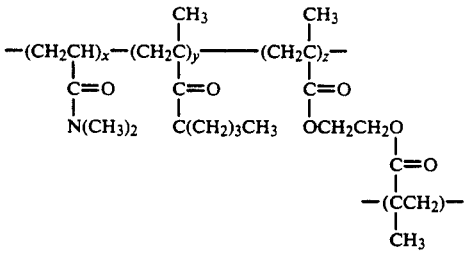

where x=30–70; y=20–60; z=0–20 mole percent,

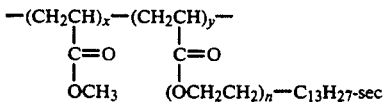

where x=20–80; y=20–80 mole percent, gum arabic, sodium alginate, pectin, cellulose acetate hydrogen phthalate, polyvinyl alcohol, hydroxyethyl cellulose, agarose, polymethacrylic acid, methyl cellulose, ethyl cellulose, methyl methacrylate, butyl methacrylate, and polyethylene oxide.

22. A process as described in claim 21, wherein said stripping polymer is coated in the range of 0 to 500 mg/m$^2$.

23. A process as described in claim 22, wherein said stripping polymer is coated in the range of 10 to 100 mg/m$^2$.

24. A process as described in claim 7, wherein said stripping layer comprises stripping agent.

25. A process as described in claim 24, wherein said stripping agent is coated at levels of 3–500 mg/m$^2$.

26. A process as described in claim 24, wherein said stripping agent has the following formula:

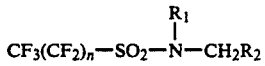

wherein $R_1$ is an alkyl or substituted alkyl group having from 1 to about 6 carbon atoms or an aryl or substituted aryl group having from about 6 to about 10 carbon atoms; $R_2$ is

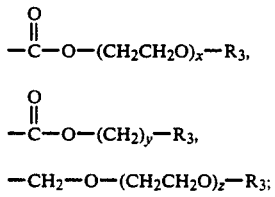

$R_3$ is H or $R_1$; n is an integer of from about 4 to about 19; x and y each independently represents an integer of from 2 to about 50; and z represents an integer of from 1 to about 50.

27. A process as described in claim 26, wherein $R_1$ is ethyl, $R_2$ is

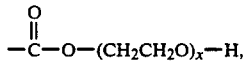

n is about 8, and x is about 25 to 50.

28. A process as described in claim 26, wherein $R_1$ is ethyl, $R_2$ is

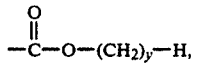

n is about 8, and y is about 25 to 50.

29. A process as described in claim 27, wherein n is about 7 and x is about 40.

30. A process as described in claim 1, wherein the barrier layer comprises a polymer containing from about $1\times10^{-5}$ to about $4\times10^{-7}$ moles/gram of ion forming functional groups such that the barrier layer reflects diffusible dye and allows the passage of processing solutions for processing the silver halide emulsion layer.

31. A process as described in claim 30, wherein the polymer is comprised of repeating units derived from ethylenically unsaturated monomers.

32. A process as described in claim 31, wherein the polymer is comprised of repeating units derived from a hydrophobic acrylate, methacrylate, acrylamide or methacrylamide monomer.

33. A process as described in claim 32, wherein the polymer is further comprised of repeating units derived from a nonionic hydrophilic ethylenically unsaturated monomer.

34. A process as described in claim 32, wherein the polymer comprises repeating units of the formula $$-(A)_m-(B)_n-$$

wherein

A is a hydrophobic monomer having the structure

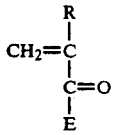

where

R is hydrogen or methyl;

E is $-OR_2$ or $-NR_3R_4$ $R_2$ is a substituted or unsubstituted straight, branched, or cyclic alkyl or aryl group of about 1 to 10 carbon atoms;

$R_3$ and $R_4$ are independently selected from hydrogen or any $R_2$ group; and $R_3$ and $R_4$ together contain at least 3 carbon atoms;

m is 0 to 99.5 mole percent;

wherein

B is an ionic hydrophilic monomer of the formula

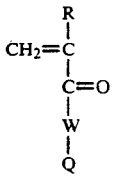

where

R is hydrogen or methyl;

W is $-OR_5$ or $-NR_6R_7$; p1 $R_5$ is a straight, branched, or cyclic alkylene or arylene group of 1 to about carbon atoms;

$R_6$ is hydrogen or a straight, branched, or cyclic alkyl or aryl group from 1 to about 6 carbon atoms;

$R_7$ is a straight, branched or cyclic alkylene or arylene group of 1 to about 10 carbon atoms;

n is 0.5 to 100 mole percent;

Q is an ionic functional group independently selected from:

(a) $-NH_2$ or the acid addition salt $-NH_2$:HX, where X is an appropriate acid anion or (b) $-CO_2M$, $-SO_2M$, $-OSO_3M$, $-OPO_3M$ and $-OM$ where M is an appropriate cation; and wherein the polymer contains from about $1\times10^{-5}$ to about $4\times10^{-3}$ moles/gram of ion forming functional groups.

35. A process as described in claim 1, wherein the barrier layer comprises a polymer coated at a level of 100 mg/m$^2$ to 10 g/m$^2$.

36. A process as described in claim 35, wherein the barrier layer comprises a polymer coated at a level of 750 mg/m$^2$ to 2 g/m$^2$.

37. A process as described in claim 34, wherein the barrier polymer is selected from the group consisting of:

$(IPA)_{90}(APM)_{10}$;
$(IPA)_{92}(APM)_{8}$;
$(IPA)_{85}(A)_{10}(APM)_{5}$;
$(TBA)_{75}(APM)_{25}$;
$(TBA)_{80}(APM)_{20}$;
$(TBA)_{83}(APM)_{17}$;
$(TBA)_{84}(APM)_{16}$;
$(NBA)_{80}(APM)_{20}$;
$(TBMA)_{80}(APM)_{20}$;
$(TBA)_{65}(IPA)_{20}(APM)_{15}$;
$(DOA)_{80}(APM)_{20}$;
$(TBA)_{60}(DOA)_{20}(APM)_{20}$;
$(TBA)_{75}(A)_{20}(SSA)_{5}$;
$(TBA)_{76}(CEA)_{8}(APM)_{16}$;
$(TBA)_{65}(A20(CEA)_{5}(APM)_{10}$;
$(TBA)_{65}(A)_{20}(SSA)_{5}(APM)_{10}$;

where the subscripts indicate mole percents, and of:

$(IPA)_{80}(MBA)_{10}(APM)_{10}$;
$(NBM)_{50}(AEM)_{15}(HEM)_{35}$;
$(NBM)_{50}(AEM)_{30}(HEM)_{20}$;
$(NBM)_{40}(AEM)_{25}(HEM)_{35}$;
$(NBM)_{26}(AEM)_{22}(HEM)_{52}$;
$(NBM)_{20}(AEM)_{15}(HEM)_{65}$;
$(NBM)_{60}(SEM)_{5}(AAM)_{10}(HEM)_{25}$;
$(NBM)_{70}(SEM)_{2.5}(AAM)_{10}(HEM)_{17.5}$;
$(BZM)_{50}(SEM)_{2.5}(AAM)_{10}(HEM)_{37.5}$;
$(2EHM)_{50}(SEM)_{5}(AAM)_{10}(HEM)_{35}$;
$(NEM)_{50}(SEM)_{5}(AAM)_{10}(HEM)_{35}$;
$(BZM)_{60}(SEM)_{2.5}(AAM)_{10}(HEM)_{27.5}$;

where the subscripts indicate weight percents, and where IPA is N-isopropylacrylamide, TBA is N-t-butylacrylamide, NBA is N-butylacrylamide, TBMA isN-t-butylmethacrylamide, DOA isN-(1,1-dimethyl-3-oxobutyl)-acrylamide, NBM isn-butylmethacrylate, 2EHM is 2-ethyl-hexylmethacrylate, BZM is benzylmethacrylate, AAM is 2-acetoacetoxyethylmethacrylate; a crosslinker, A is acrylamide, HEM is hydroxyethylmethacrylate, MBA is methylene-bis-acrylamide (difunctional), APM is N-(3-aminopropyl)methacrylamide hydrochloride, AEM is aminoethylmethacrylate hydrochloride, SEM is sulfoethylmethacrylate sodium salt, SSA is N-(2- sulfo- 1, I -dimethylethyl)acrylamide sodium salt, and CEA is N-2-carboxyethylacrylamide.

38. A process as described in claim 1, wherein the diffusible dye forming compound is a coupler molecule selected from the group consisting of Dye-Y-Cp-D-B wherein Dye is a dye radical exhibiting selective absorption in the visible spectrum and contains an acidic solubilizing group;

Y is a linking radical selected from the group consisting of an azo radical, a mercuri radical, an oxy radical, a thio radical, a dithio radical, and an azoxy radical;

Cp is a coupler radical selected from the group consisting of a 5-pyrazolone coupler radical, a phenolic coupler radical, and an open chain ketomethylene coupler radical, said Cp being substituted in the coupling position with said Y linking group;

D is a linking radical selected from the group consisting of an azo radical, a mercuri radical, an oxy radical, an alkylidene radical, a thio radical, a dithio radical, and an azoxy radical;

B is a photographically inert organic ballasting radical of such molecular size and configuration as to render said couplers nondiffusible during development in alkaline color developing solution.

39. A process as described in claim 1, wherein the diffusible dye forming compound is a coupler molecule selected from the group consisting of B-Y-Cp-D-R wherein:

B is a photographically inert organic ballasting radical of such molecular size and configuration as to render said couplers nondiffusible during development in alkaline color developing solution;

Y is a linking radical selected from the group consisting of an azo radical, a mercuri radical, an oxy radical, an alkylidene radical, a thio radical, a dithio radical, and an azoxy radical;

Cp is a coupler radical selected from the group consisting of a 5-pyrazolone coupler radical, a phenolic coupler radical, and an open chain ketomethylene to coupler radical, said Cp being substituted in the coupling position with said Y linking group;

D is a linking radical selected from the group consisting of an azo radical, a mercuri radical, an oxy radical, an alkylidene radical, a thio radical, a dithio radical, and an azoxy radical;

R is selected from the group consisting of a hydrogen atom and an acidic solubilizing group when said color developing agent contains an acidic solubilizing group, and R is an acidic solubilizing group when said color developing agent is free of an acidic solubilizing group.

40. A process as described in claim 1, wherein the diffusible dye forming compound is a molecule selected from the group consisting of

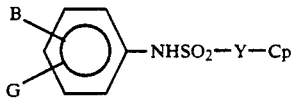

wherein:

B is a photographically inert organic ballasting radical of such molecular size and configuration as to render said molecule nondiffusible during development in alkaline color developing solution;

G is an —OR or —$NR_1R_2$ radical wherein R is hydrogen or a hydrolyzable moiety and $R_1$ and $R_2$ are each hydrogen or an alkyl group;

Y is a linking radical selected from the group consisting of an azo radical, a mercuri radical, an oxy radical, an alkylidene radical, a thio radical, a dithio radical, and an azoxy radical;

Cp is a coupler moiety capable of reacting with oxidized aromatic primary amino color developing agent to produce a diffusible dye, a diffusible dye radical, or a diffusible dye precursor.

41. A process as described in claim 1, wherein the diffusible dye forming compound is a molecule selected from the group consisting of

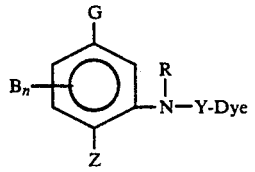

wherein:

$B_n$ is one or more photographically inert organic ballasting radicals of such molecular size and configuration as to render said molecule nondiffusible during development in alkaline color developing solution;

G is an —OR′ or —$NR_1R_2$ radical wherein R′ is hydrogen or a hydrolyzable moiety and $R_1$ and $R_2$ are each hydrogen or an alkyl group;

Z is hydrogen or is selected from the group consisting of radicals replaceable by oxidized aromatic amino color developer;

R is hydrogen, alkyl, or substituted alkyl;

Y is a divalent linking radical linking selected from the group consisting of an azo radical, a mercuri radical, an oxy radical, an alkylidene radical, a thio radical, a dithio radical, and an azoxy radical;

Dye is a dye radical or dye precursor.

42. A diffusion transfer process for forming a color photographic image comprising the steps of:

(a) using an integral element comprising one and only one dimensionally stable layer comprising a coating support, and coated thereon in reactive association a mordant layer comprising a material which binds a diffusible dye, an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer containing from about $1\times10^{-5}$ to about $4\times10^{-7}$ moles/gram of ion forming functional groups such that the barrier layer reflects diffusible dye and allows the passage of solutions for processing said element when said element is contacted with an external processing bath;

(b) exposing said element to actinic radiation (c) processing said element by contacting said element to an external bath containing compounds selected from the group consisting of color developer compounds of the primary amine type, compounds which activate the release of incorporated color developers, and compounds which activate development by incorporated dye developers;

(d) washing said element to remove compounds imbibed in step (c).

43. A process as described in claim 42, wherein said barrier layer is the most distal layer with respect to said support.

44. A process as described in claim 42, wherein said mordant layer comprises an ultraviolet filter dye.

45. A process as described in claim 42, wherein said external bath comprises a volume greater than 20 mL per square meter of element contacting said bath.

46. A process as described in claim 42, wherein said external bath comprises a volume greater than 200 mL per square meter of element contacting said bath.

47. A process as described in claim 42, wherein said integral element further comprises a stripping layer coated intermediate said mordant layer and a diffusible dye forming layer.

48. A process as described in claim 42, further comprising the step of separating said mordant and support from said diffusible dye forming layer.

49. A process as described in claim 48, further comprising the step of drying said element intermediate said washing and separating steps.

50. A process as described in claim 49, further comprising the step of heating said element prior to and during the separating step.

51. A process as described in claim 42, wherein said mordant layer comprises mordant polymer.

52. A process as described in claim 51, wherein said mordant polymer comprises vinyl monomer units having tertiary amino groups or quaternary ammonium groups and wherein said vinyl monomer units are selected from the group consisting of:

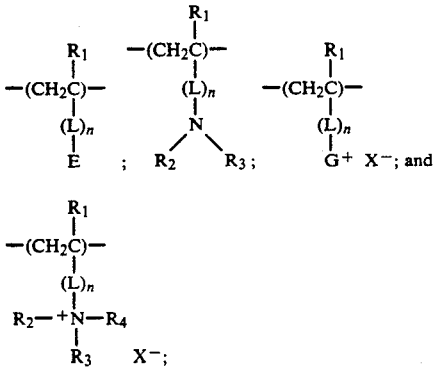

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; n is 0 or 1; $R_2$, $R_3$, and $R_4$ are the same or different and each represents an alkyl group having 1 to 12 carbon atoms or an aralkyl group having 7 to 20 carbon atoms; $G^+$ represents a hetero ring which is quarternized and contains a carbon-nitrogen double bond; $X^-$ represents a monovalent anion; and $R_2$ and $R_3$, $R_3$ and $R_4$, or $R_2$ and $R_4$ may form, together with the adjacent nitrogen atom, a cyclic structure.

53. A process as described in claim 42, wherein said mordant layer comprises mordant polymer at a coverage of 0.5-8 g/m$^2$.

54. A process as described in claim 42, wherein said mordant layer comprises mordant polymer with molecular weight in the range of 10,000-2,00,000.

55. A process as described in claim 54, wherein said mordant layer comprises hydrophilic binder.

56. A process as described in claim 55, wherein said hydrophilic binder is gelatin.

57. A process as described in claim 56, wherein said mordant layer comprises a weight-ratio of mordant polymer to hydrophilic binder in the range of 1:5 to 5:1.

58. A process as described in claim 47, wherein said stripping layer comprises stripping polymer selected from the group consisting of:

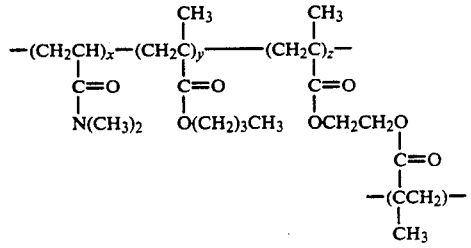

where x=30-70; y=20-60; z=0-20 mole percent,

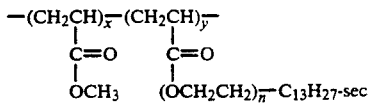

where x=20-80; y=20-80 mole percent, gum arabic, sodium alginate, pectin, cellulose acetate hydrogen phthalate, polyvinyl alcohol, hydroxyethyl cellulose, agarose, polymethacrylic acid, methyl cellulose, ethyl cellulose, methyl methacrylate, butyl methacrylate, and polyethylene oxide.

59. A process as described in claim 58, wherein said stripping polymer is coated in the range of 10 to 100 mg/m$^2$.

60. A process as described in claim 47, wherein said stripping layer comprises stripping agent at levels of 3-500 mg/m$^2$.

61. A process as described in claim 60, wherein said stripping agent has the following formula:

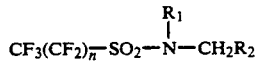

wherein $R_1$ is an alkyl or substituted alkyl group having from 1 to about 6 carbon atoms or an aryl or substituted aryl group having from about 6 to about 10 carbon atoms; $R_2$ is

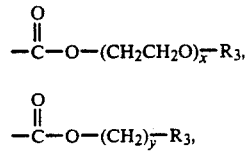

or

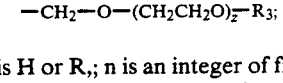

$R_3$ is H or R,; n is an integer of from about 4 to about 19; x and y each independently represents an integer of from 2 to about 50; and z represents an integer of from 1 to about 50.

62. A process as described in claim 61, wherein $R_1$ is ethyl, $R_2$ is

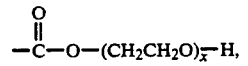

n is about 8, and x is about 25 to 50.

63. A process as described in claim 62, wherein $R_1$ is ethyl, $R_2$ is

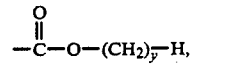

n is about 8, and y is about 25 to 50.

64. A process as described in claim 62, wherein n is about 7 and x is about 40.

65. A process as in claim 42, wherein the barrier layer polymer is comprised of repeating units derived from ethylenically unsaturated monomers.

66. A process as described in claim 65, wherein the barrier layer polymer is comprised of repeating units derived from a hydrophobic acrylate, methacrylate, acrylamide or methacrylamide monomer.

67. A process as described in claim 66, wherein the polymer is further comprised of repeating units derived from a nonionic hydrophilic ethylenically unsaturated monomer.

68. A process as described in claim 66, wherein the polymer comprises repeating units of the formula $$-(A)_m-(B)_n-$$

wherein

A is a hydrophobic monomer having the structure

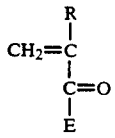

wherein

R is hydrogen or methyl;

E is $-OR_2$ or $-NR_3R_4$;

$R_2$ is a substituted or unsubstituted straight, branched, or cyclic alkyl or aryl group of about 1 to 10 carbon atoms;

$R_3$ and $R_4$ are independently selected from hydrogen or any $R_2$ group; and $R_3$ and $R_4$ together contain at least 3 carbon atoms;

m is 0 to 99.5 mole percent;

wherein

B is an ionic hydrophilic monomer of the formula

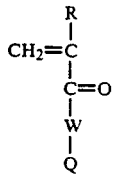

where

R is hydrogen or methyl;

W is $-OR_5$ or $-NR_6R_7$;

$R_5$ is a straight, branched, or cyclic alkylene or arylene group of 1 to about 10 carbon atoms;

$R_6$ is hydrogen or a straight, branched, or cyclic alkyl or aryl group from 1 to about 6 carbon atoms;

$R_7$ is a straight, branched or cyclic alkylene or arylene group of I to about 10 carbon atoms;

n is 0.5 to 100 mole percent;

Q is an ionic functional group independently selected from:

(a) $-NH_2$ or the acid addition salt $-NH_2{:}HX$, where X is an appropriate acid anion or (b) $-CO_2M$, $-SO_2M$, $-OSO_3M$, $-OPO_3M$ and $-OM$ where M is an appropriate cation;

and wherein the polymer contains from about $1\times10^{-5}$ to about $4\times10^{-3}$ moles/gram of ion forming functional groups.

69. A process as described in claim 42, Wherein the barrier layer comprises a polymer coated at a level of 750 mg/m$^2$ to 2 g/m$^2$.

70. A process as described in claim 68, wherein the barrier polymer is selected from the group consisting of:

$(IPA)_{90}(APM)_{10}$;
$(IPA)_{92}(APM)_{8}$;
$(IPA)_{85}(A)_{10}(APM)_{5}$;
$(TBA)_{75}(APM)_{25}$;
$(TBA)_{80}(APM)_{20}$;
$(TBA)_{83}(APM)_{17}$;
$(TBA)_{84}(APM)_{16}$;
$(NBA)_{80}(APM)_{20}$;
$(TBMA)_{80}(APM)_{20}$;
$(TBA)_{65}(IPA)_{20}(APM)_{15}$;
$(DOA)_{80}(APM)_{20}$;
$(TBA)_{60}(DOA)_{20}(APM)_{20}$;
$(TBA)_{75}(A)_{20}(SSA)_{5}$;
$(TBA)_{76}(CEA)_{8}(APM)_{16}$;
$(TBA)_{65}(A20(CEA)_{5}(APM)_{10}$;
$(TBA)_{65}(A)_{20}(SSA)_{5}(APM)_{10}$;

where the subscripts indicate mole percents, and of:

$(IPA)_{80}(MBA)_{10}(APM)_{10}$;
$(NBM)_{50}(AEM)_{15}(HEM)_{35}$;
$(NBM)_{50}(AEM)_{30}(HEM)_{20}$;
$(NBM)_{40}(AEM)_{25}(HEM)_{35}$;
$(NBM)_{26}(AEM)_{22}(HEM)_{52}$;
$(NBM)_{20}(AEM)_{15}(HEM)_{65}$;
$(NBM)_{60}(SEM)_{5}(AAM)_{10}(HEM)_{25}$;
$(NBM)_{70}(SEM)_{2.5}(AAM),O(HEM)_{17.5}$;
$(BZM)_{50}(SEM)_{2.5}(AAM)_{10}(HEM)_{37.5}$;
$(2EHM)_{50}(SEM)_{5}(AAM)_{10}(HEM)_{35}$;
$(NEM)_{50}(SEM)_{5}(AAM)_{10}(HEM)_{35}$;
$(BZM)_{60}(SEM)_{2.5}(AAM)_{10}(HEM)_{27.5}$;

where the subscripts indicate weight percents, and where EPA is N-isopropylacrylamide, TBA is N-t-butylacrylamide, NBA is N-butylacrylamide, TBMA is N-t-butylmethacrylamide, DOA is N-(1,1-dimethyl-3-oxobutyl)-acrylamide, NBM is N-butylmethacrylate, 2EHM is 2-ethyl-hexylmethacrylate, BZM is benzylmethacrylate, AAM is 2-acetoacetoxyethylmethacrylate; a crosslinker, A is acrylamide, HEM is hydroxyethylmethacrylate, MBA is methylene-bis-acrylamide (difunctional), APM is N-(3-aminopropyl)methacrylamide hydrochloride, AEM is aminoethylmethacrylate hydrochloride, SEM is sulfoethylmethacrylate sodium salt, SSA is N-(2-sulfo-1,1-dimethylethyl)acrylamide sodium salt, and CEA is N-2-carboxyethylacrylamide.

* * * * *

UNITED STATES PATENT AND TRADEMARK OFFICE

CERTIFICATE OF CORRECTION

PATENT NO. : 5,288,745

DATED : February 22, 1994

INVENTOR(S) : John Texter et al

It is certified that error appears in the above-indentified patent and that said Letters Patent is hereby corrected as shown below:

Column 37, line 4, "an-fine" should read —amine—.
Column 45, line 38, delete "pl".
Column 45, line 40, after "about" insert —10—.
Column 47, line 16, delete "to".
Column 48, line 63, "42" should read —47—.
Column 49, line 45, "2,00,000" should read —200,000—.
Column 50, line 42, "R," should read —Rl—.
Column 51, line 53, "I" should read —l—.
Column 52, line 8, "42, Wherein" should read —42, wherein—.
Column 52, line 27, "(TBA)65(A20(CEA)5(APM)10" should read

—(TBA)65($A_{20}$(CEA)5(APM)10"—

Column 52, line 37, "(NBM)70(SEM)2.5(AAM),0(HEM)17.5" should read

—(NBM)70(SEM)$_{2.5}$(AAM)1-(HEM)17.5—

Signed and Sealed this

Thirteenth Day of September, 1994

*Attest:*

*Attesting Officer*

BRUCE LEHMAN

*Commissioner of Patents and Trademarks*